US005382129A

United States Patent [19]

Shimizu et al.

[11] Patent Number: 5,382,129

[45] Date of Patent: Jan. 17, 1995

[54] SHEET FEED DEVICE FOR AN IMAGE FORMING APPARATUS

[75] Inventors: Tomohito Shimizu, Yokohama; Hiroshi Mori, Yamato; Yoshinobu Kagami, Yokohama; Takeshi Yamakawa, Fujisawa; Susumu Shiina, Tokyo; Keisuke Hayashi, Kawasaki, all of Japan

[73] Assignee: Ricoh Company, Ltd., Tokyo, Japan

[21] Appl. No.: 5,071

[22] Filed: Jan. 15, 1993

[30] Foreign Application Priority Data

Jan. 16, 1992 [JP] Japan ..... 4-005985

[51] Int. Cl.[6] ..... B65H 1/30

[52] U.S. Cl. ..... 414/411; 53/381.1; 414/412

[58] Field of Search ..... 414/403, 404, 411, 412, 414/416, 418; 221/22, 23; 271/238, 240, 277, 264, 272, 273, 274; 53/381.1

[56] References Cited

U.S. PATENT DOCUMENTS

| | | | |
|---|---|---|---|
| 3,934,150 | 1/1976 | Matsumoto et al. | 414/412 |
| 4,167,673 | 9/1979 | Stievenart et al. | 414/411 |
| 4,531,878 | 7/1985 | Tamura | 414/412 |
| 4,571,140 | 2/1986 | Yamada et al. | 414/411 X |
| 4,590,738 | 5/1986 | Hösel et al. | 414/411 X |
| 4,696,615 | 9/1987 | Ettischer et al. | 414/412 X |
| 4,783,588 | 11/1988 | Schmidt et al. | 414/411 X |

FOREIGN PATENT DOCUMENTS

| | | | |
|---|---|---|---|
| 97145 | 5/1985 | Japan . | |
| 203534 | 8/1988 | Japan . | |
| 9134 | 1/1989 | Japan | 414/412 |
| 1188053 | 10/1985 | U.S.S.R. | 414/412 |
| 8810226 | 12/1988 | WIPO | 414/412 |

*Primary Examiner*—Frank E. Werner
*Attorney, Agent, or Firm*—Oblon, Spivak, McClelland, Maier & Neustadt

[57] ABSTRACT

A sheet feed device incorporated in a copier, facsimile transceiver, printer or similar image forming apparatus and capable of automatically removing a wrapping from a sheet pack inserted in the apparatus and then feeding sheets one by one.

7 Claims, 25 Drawing Sheets

SHEET FEED DEVICE FOR AN IMAGE FORMING APPARATUS

BACKGROUND OF THE INVENTION

The present invention relates to a copier, facsimile transceiver, printer or similar image forming apparatus and, more particularly, to a sheet feed device incorporated in such an apparatus for automatically removing a wrapping from a sheet pack and then feeding unwrapped sheets one by one.

It has been customary with a conventional image forming apparatus to supplement sheets entirely by hand. Specifically, to supplement sheets, the operator pulls out a cassette or tray from the sheet feed device, removes the top cover of the cassette, unwraps a sheet pack, raises sheet pressing members or corner pawls disposed in the cassette, neatly arranges unwrapped sheets in a stack, loads the cassette with the sheet stack, puts the sheet pressing members on the sheet stack, and then sets the cassette in the device. Such a procedure including a great number of steps is time- and labor-consuming, especially for users who use a great amount of sheets.

In the light of the above, a sheet feed device has been proposed which allows the operator to set a predetermined number of sheets in the form of a sheet pack directly in the body thereof and automatically unwraps the pack and then feeds sheets by mechanisms built therein. For example, Japanese Patent Laid-Open Publication No. 203534/1988 discloses a method and an apparatus which allows the operator to stack multiple sheet packs each accommodating a predetermined number of sheets one above another, moves one of the sheet packs forward while cutting opposite sides of the wrapping of the pack with a cutter, sucks the top and bottom of the cut wrapping to remove it, gripping unwrapped sheets to bring them to a transport table, and then moves the transport table to a sheet loading position. On the other hand, Japanese Patent Laid-Open Publication No. 97145/1985 teaches an implementation using sheets accommodated in a box formed of cardboard, resin or similar relatively hard wrapping material. In this case, the operator removes the portions of the box which will contact a pick-up roller, separator pawl and so forth and then puts the box in a sheet feed position in the image forming apparatus. Such an implementation allows the box to serve as a cassette.

However, unwrapping a sheet pack by a cutter as stated above is undesirable since the cutter is apt to cut the sheets together with the wrapping. This problem is critical when it comes to, among others, a copier or similar image forming apparatus. Moreover, the suction used to remove the wrapping increases the overall size of the device while aggravating noise. On the other hand, the above-stated scheme using the transport table has a problem that gripping and transporting an unwrapped sheet stack is likely to disturb the neat stack and, in the worst case, scatters around the sheets. Moreover, cardboard, resin or similar hard wrapping material constituting the box is disproportionately expensive since it is expected to accommodate only several hundred sheets. The box is formed with perforations to allow the end portion thereof to be removed by the user. The perforations expose the sheets in the box to the atmosphere and, when the sheets are stored over a long time, cause the sheets to absorb moisture, adversely influencing image formation to be effected. In addition, the box has to be partly protruded to the outside of the device to be removed with ease. This is contradictory to the increasing demand for space saving.

SUMMARY OF THE INVENTION

It is, therefore, an object of the present invention to provide a sheet feed device for an image forming apparatus which simplifies a sheet supplementing operation to a significant degree.

It is another object of the present invention to provide a sheet feed device capable of automatically removing a wrapping from a sheet pack inserted into the body of an image forming apparatus.

In accordance with the present invention, a sheet feed device capable of automatically removing a wrapping from a sheet pack inserted into an image forming apparatus comprises a device body, an inlet formed through one side wall of the device body for allowing the sheet pack to be inserted, a transporting mechanism for transporting the sheet pack inserted through the inlet to a predetermined position defined in the device body, and an unwrapping mechanism for removing the wrapping from the sheet pack located at the predetermined position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
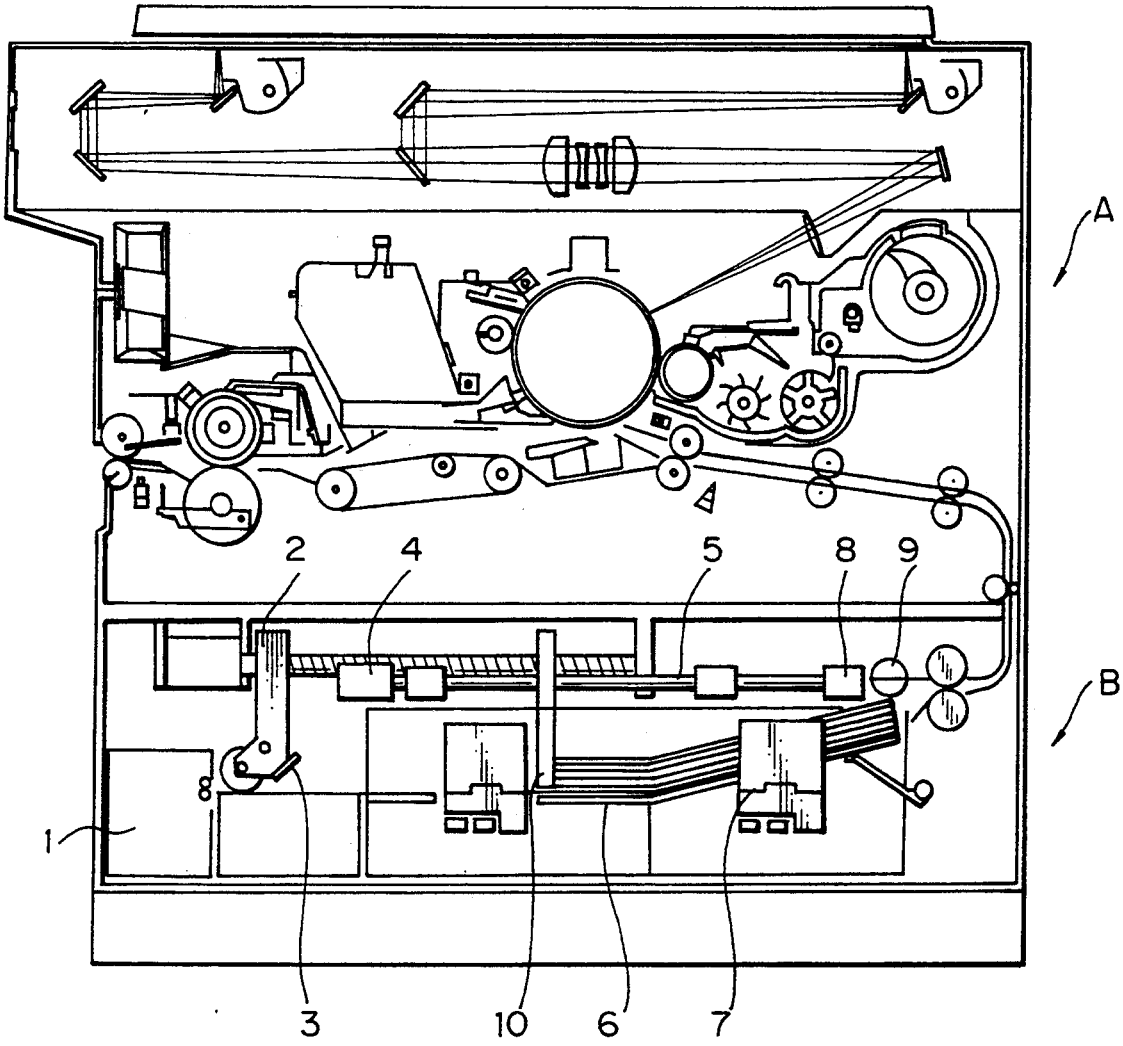
FIG. 1 is a section of a copier which is a specific form of an image forming apparatus implemented with a sheet feed device embodying the present invention.

Referring to FIG. 1 of the drawings, an image forming apparatus with a sheet feed device embodying the present invention is shown. As shown, the image forming apparatus has a conventional copier body A and a fully automatic sheet feed device B embodying the present invention. The sheet feed device B has a dust bin for receiving wrappings removed from sheet packs, an unwrapping unit 2 for unwrapping a sheet pack, an inlet guide 3, a motor 4 for driving a transport roller which will be described, an output shaft 5 extending out from the motor 4, a tray 6 to be loaded with sheets, a plurality of side fences 7 for positioning the side edges of sheets on the tray 6 and each matching a particular size, a transport roller 8 for transporting sheets in the widthwise direction, a pick-up roller 9 for driving sheets toward the copier body A, and a back fence 10 for positioning the rear edges of sheets.

Figure 2:
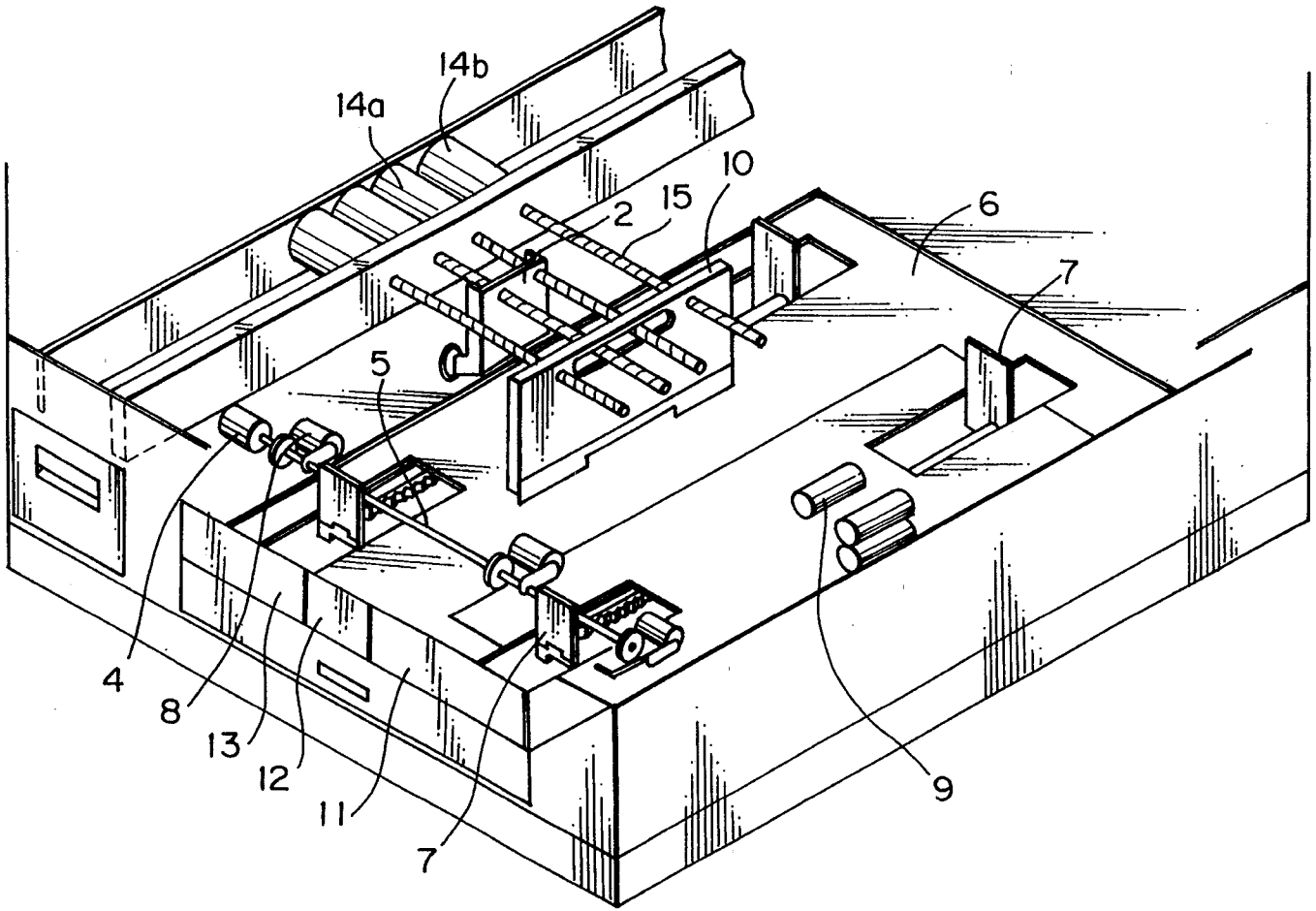
FIG. 2 is a perspective view of the sheet feed device shown in FIG. 1.
Figure 3A:
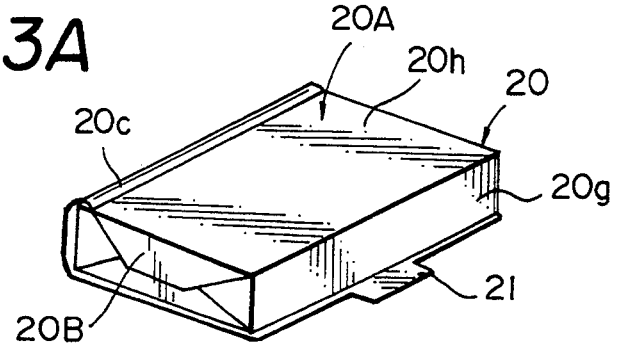
FIGS. 3A–3D are perspective views showing a sheet pack and a procedure for unwrapping it.
Figure 3B:
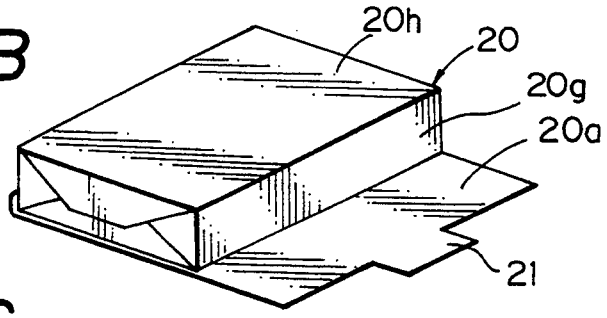
Figure 3C:
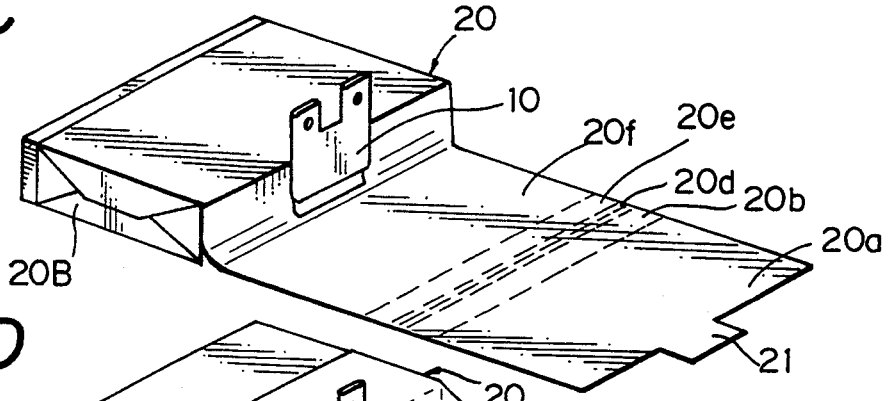
Figure 3D:
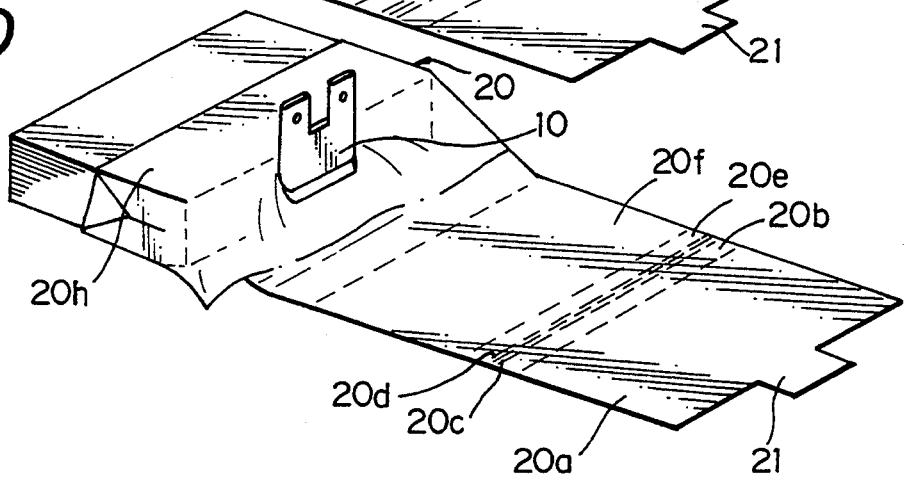
Figure 4:
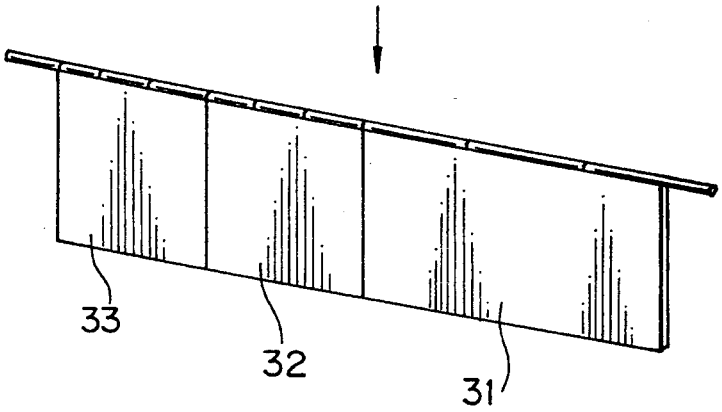
FIG. 4 is a perspective view of doors associated with a sheet inlet.
Figure 5:
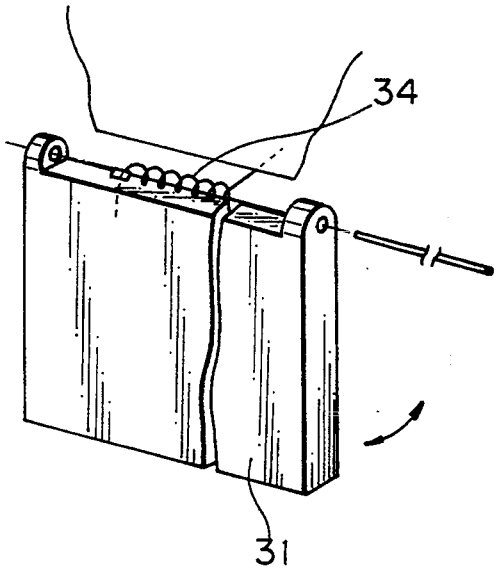
FIG. 5 is an enlarged perspective view of one of the doors.
Figure 6:
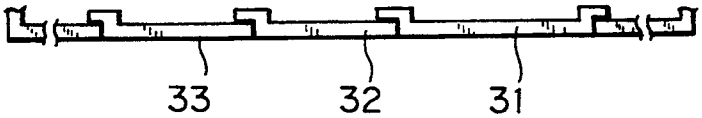
FIG. 6 is a plan view of the doors.

As shown in FIG. 2 more specifically, the sheet feed device B has sheet inlets 11, 12 and 13 at the front (front of the copier) which are assigned to sheets sizes of A5, A4 and A3, respectively. A sheet pack 20 shown in FIGS. 3A–3D is inserted into associated one of the sheet inlets 11–13 with the right side of the inlet as a reference and with a tongue 21 thereof located at the left-hand side. As shown in FIGS. 4–7, doors 31, 32 and 33 are associated with the sheet inlets 11, 12 and 13, respectively, and each serves as a guide for the sheet pack 20. For example, assuming that the sheet pack of A4 size is inserted into the sheet inlet 12, then the door 33 associated with the inlet 13 for A3 does not open and serves to guide, i.e., prevent the sheet pack 20 from being dislocated sideways. As shown in FIG. 5, each door (represented by the door 31) is automatically returned to the original position by a spring 34 after the insertion of the pack 20.

Figure 7:
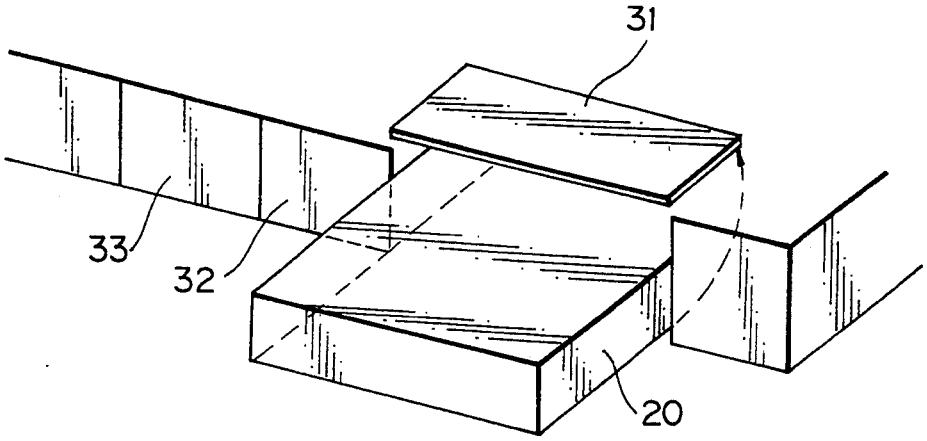
FIG. 7 is a perspective view showing a sheet pack being inserted into the sheet inlet.
Figure 8:
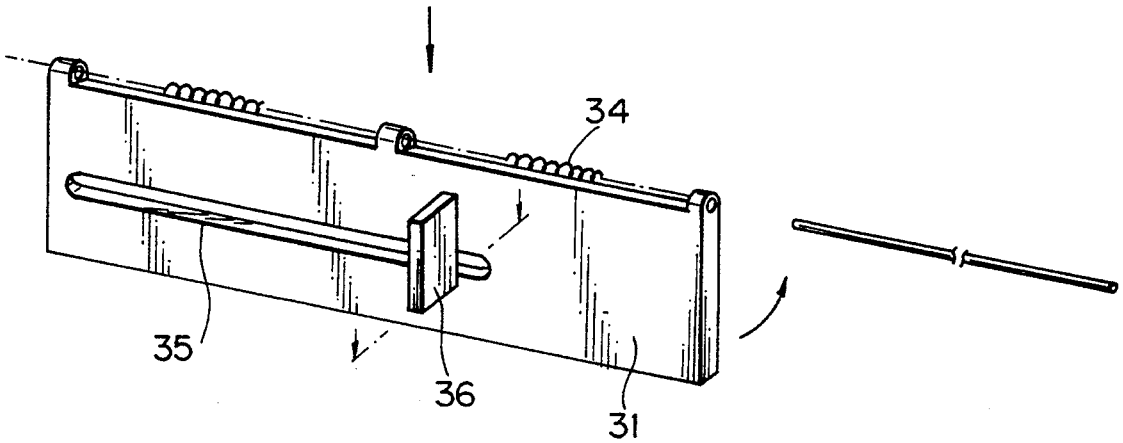
FIG. 8 is a perspective view showing another specific configuration of the door.
Figure 9:
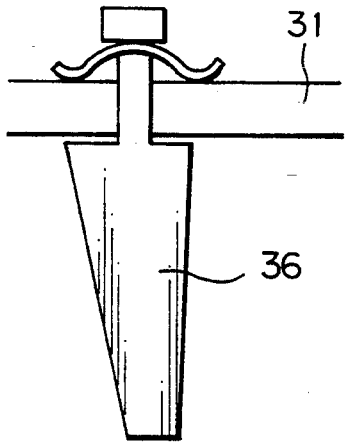
FIG. 9 is a plan view showing another specific configuration of the door.

While the embodiment has three sheet inlets for A5, A4 and B3 sizes, the inlets may be subdivided to additionally accommodate the B series, as shown in FIG. 7. Alternatively, as shown in FIGS. 8 and 9, a guide piece 36 may be slidably received in a groove 35 formed in the door (represented by the door 31). Then, the guide piece 36 will be moved in the right-and-left direction in matching relation to the sheet size. In FIG. 2, there are also shown an unwrap motor 14*a* for unwrapping a sheet pack, a drive motor 14*b* for driving the back fence 10, and a male screw 15 mounted on the output shaft of the motor 14*b*.

Figure 10:
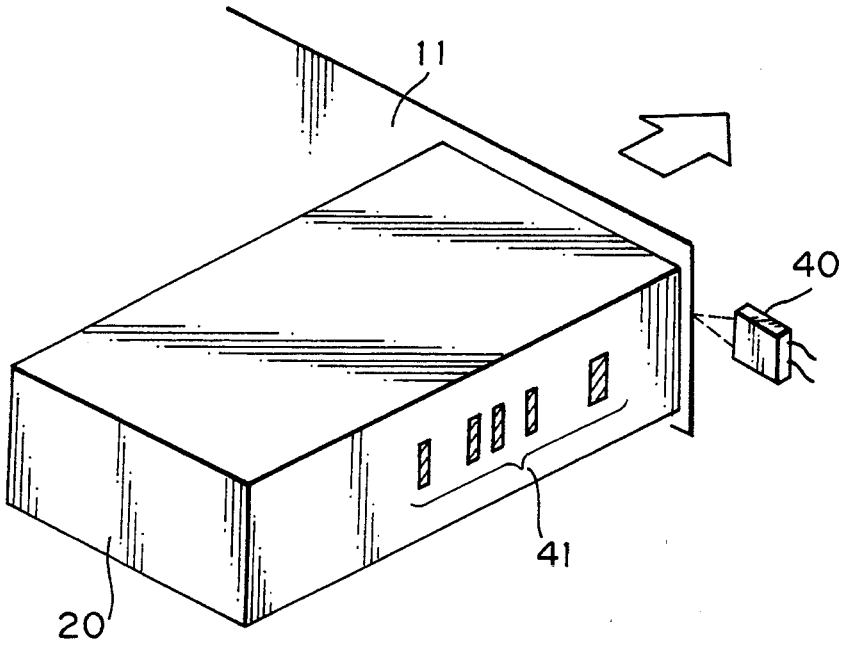
FIG. 10 is a perspective view showing a specific mechanism for sensing a sheet pack.

FIG. 10 shows a specific mechanism for sensing the sheet pack 20. As shown, a bar code reader 40, for example, is located at the reference position, i.e., at the right-hand side of the sheet inlet (represented by the sheet inlet 11). The bar code reader 40 senses the sheet pack 20 being inserted into the sheet inlet by reading a bar code 41 provided on one side face of the pack 20.

Figure 11:
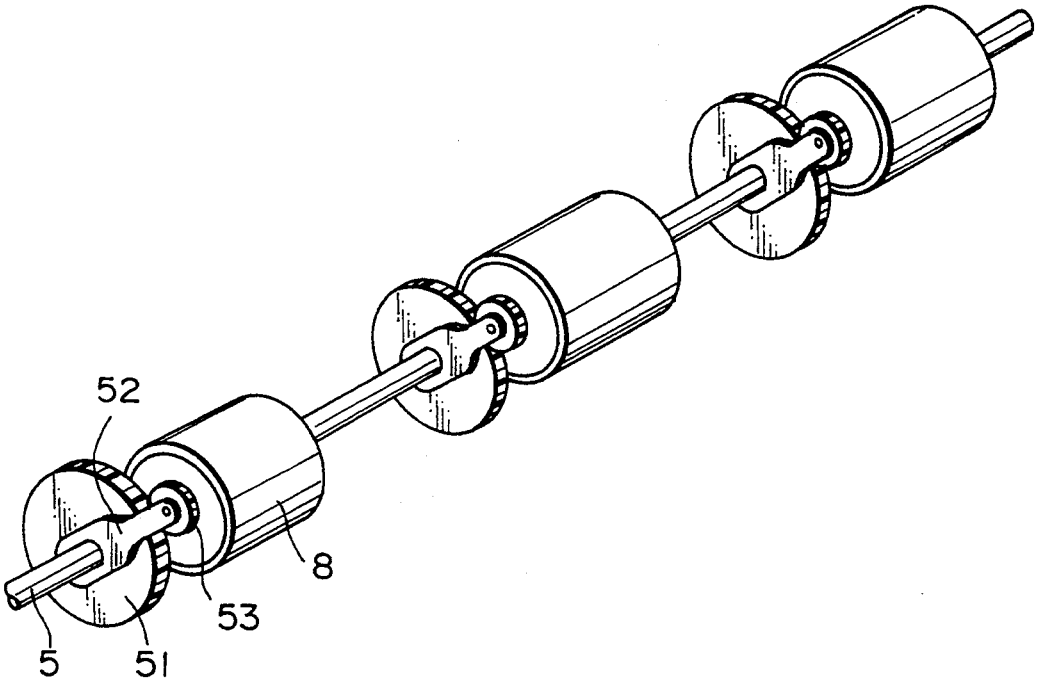
FIG. 11 is a perspective view of a transport roller section.
Figure 12:
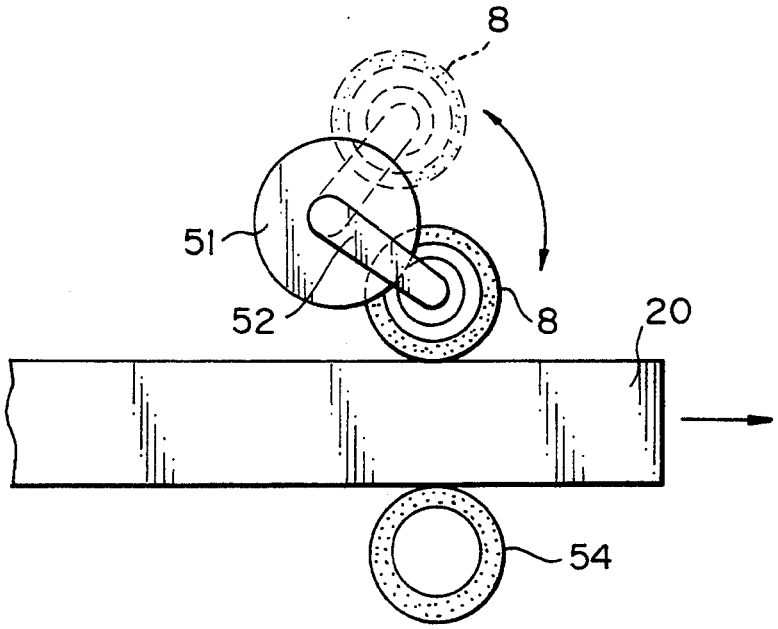
FIG. 12 shows how a sheet pack enters the device and how the transport roller rotates.

FIG. 11 shows a transport roller arrangement while FIG. 12 shows how the sheet pack 20 enters the sheet feed device B and how the transport roller rotates. The transport roller 8 is usually retracted to a position above the sheet inlet so as not to interfere with the sheet pack 20. There are shown in the figures a drive gear 51 rotatable integrally with the output shaft 5 of the motor 4, an arm 52 rotatable about the shaft 5, a planetary gear 53 mounted on the tree end of the arm 52 and meshing with the drive gear 51, and a driven roller 54 made of a low friction material for smoothly transporting the sheet pack 20. If desired, the driven roller 54 may be replaced with a sheet, e.g., a Teflon sheet. As shown in FIG. 12, when the drive gear 51 is rotated counterclockwise, the transport roller 8 coaxial with the planetary gear 53 is rotated counterclockwise together with the arm 52 to the above-mentioned retracted position (phantom line). Conversely, when the drive gear 51 is rotated clockwise, the transport roller 8 is also rotated clockwise to rest on the top of the sheet pack 20. Then, the transport roller 8 is rotated counterclockwise about the axis thereof by the drive gear 51 to feed the sheet pack 20 in a direction indicated by an arrow in FIG. 12.

Figure 13:
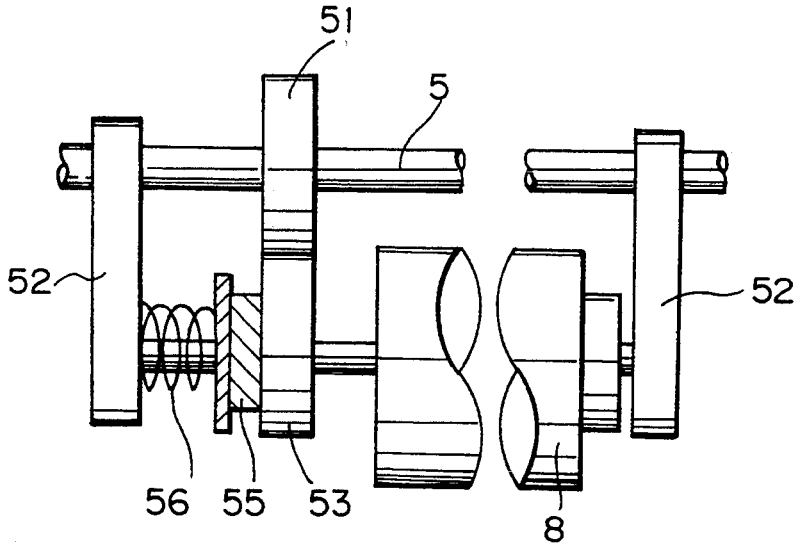
FIGS. 13 and 14 each shows a specific form of a false load member associated with the transport roller.
Figure 14:
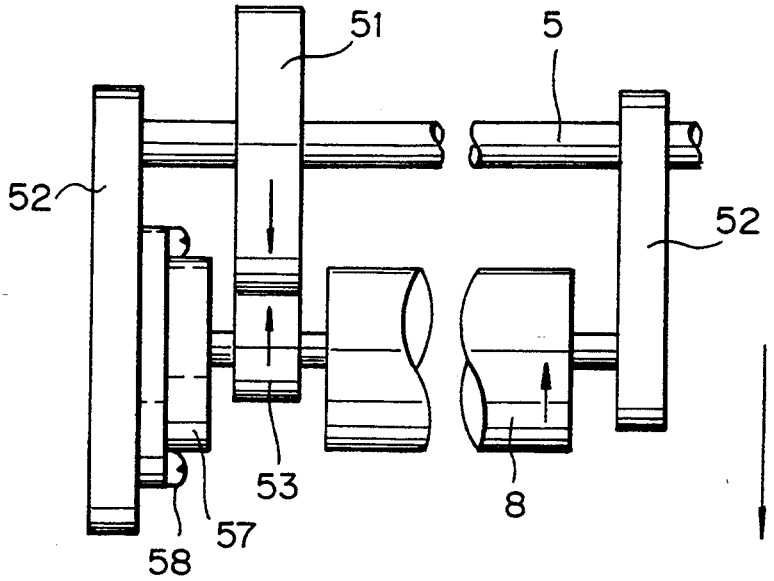
Figure 15:
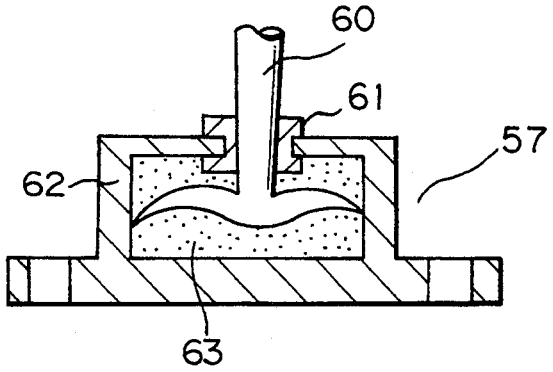
FIG. 15 is a vertical section of the false load member shown in FIG. 14.

FIGS. 13 and 14 each shows an example of a false load member acting on the transport roller 8. FIG. 15 is a vertical section of the false load member shown in FIG. 14. Specifically, the false load member shown in FIG. 13 is implemented as a friction member 55 formed of cork or felt and urged against the planetary gear 53 by a coil spring 56. In this configuration, a frictional force acts on one end of the planetary gear 53 to thereby exert a load on the roller 8. On the other hand, the false load member shown in FIG. 14 is constituted by a damper 57 fastened to the arm 52 by screws 58. The damper 57 may be implemented as a hydraulic damper or a power torque limiter by way of example. FIG. 15 shows a hydraulic damper 57 having a shaft 60 directly coupled to the planetary roller, and a bladed wheel formed at the end of the shaft 60. The reference numeral 61 designates a seal member for preventing viscous oil 63 from leaking while the reference numeral 62 designates a cover. The oil 63 is filled in the damper 57.

As shown in FIG. 12, as the transport roller 8 contacts the sheet pack 20, the false load member begins to slide. As a result, the transport roller 8 having been rotated together with the drive gear 51 begins to rotate about its own axis, further driving the sheet pack 20 into the mechanism. An arrangement may be made such that when the sheet pack 20 is not expected or exclusive one as determined by, for example, the bar code reader 40, the transport roller 8 is reversed to discharge the pack 20 to the outside.

Figure 16:
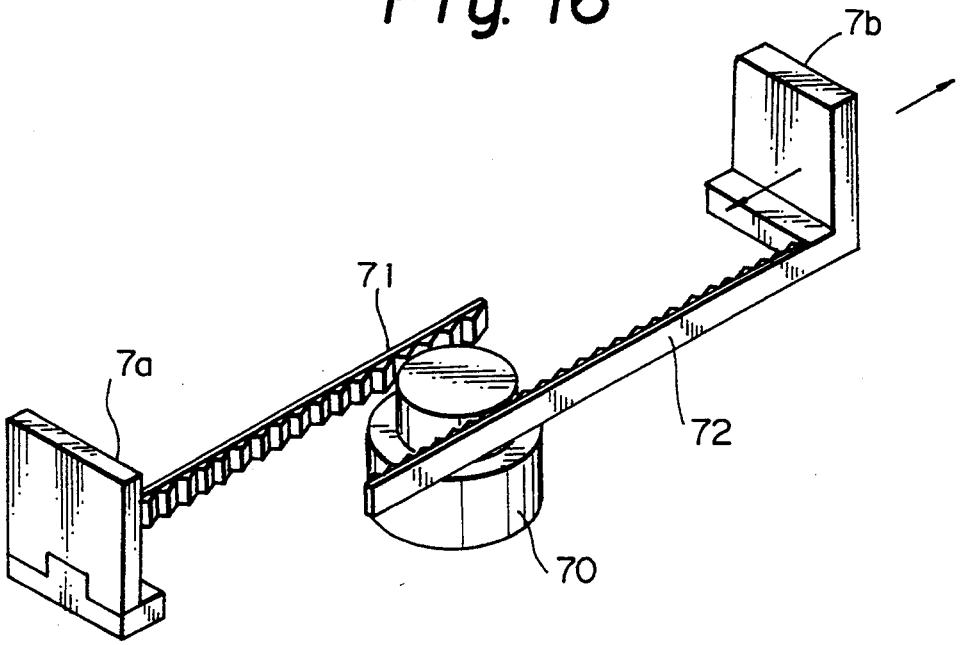
FIG. 16 is a perspective view of a mechanism for moving side fences.
Figure 17:
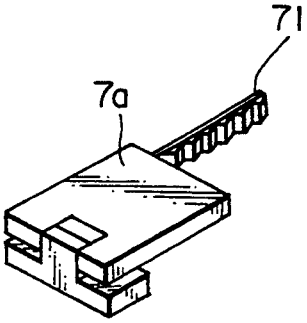
FIG. 17 is a perspective view showing one of the side fences in a collapsed position.

FIG. 16 shows a mechanism for moving the side fences 7. FIG. 17 shows one side fence in a collapsed position. As shown in FIG. 16, the front side fence 7*a* and the rear side fence 7*b* each has a rack 72 meshing with a side fence drive motor 70 (toothed portion). As the motor 70 is rotated, the side fences 7*a* and 7*b* move toward or away from each other. When the sheet pack 20 enters the copier, the front side fence 7*a* is collapsed to the rear by the sheet pack 20 to facilitate the entry of the pack 20. The side fences 7 and back fence 10 are moved to their retracted positions (maximum sizes) when sheets are absent as determined by a sheet sensor, not shown. The transport roller 8 is located at the rear of the side fences 7 while the side fence 7*a* is constantly biased by a spring toward the upright position. Hence, when the trailing end of the sheet pack 20 moves away from the side fence 7*a*, the side fence 7*a* is automatically restored to the upright position. After the side fence 7*a* has risen to such a position, the side fences 7 are brought to the center, i.e., the reference transport position of the sheet pack 20 by the motor 70. After the side fences 7 have positioned the sheet pack 20, the back fence 10 positions the pack 20 in the front-and-rear direction. At this instant, the back fence 10 is moved over a particular distance on the basis of the sheet size determined in the event of movement of the side fences 7.

Figure 18:
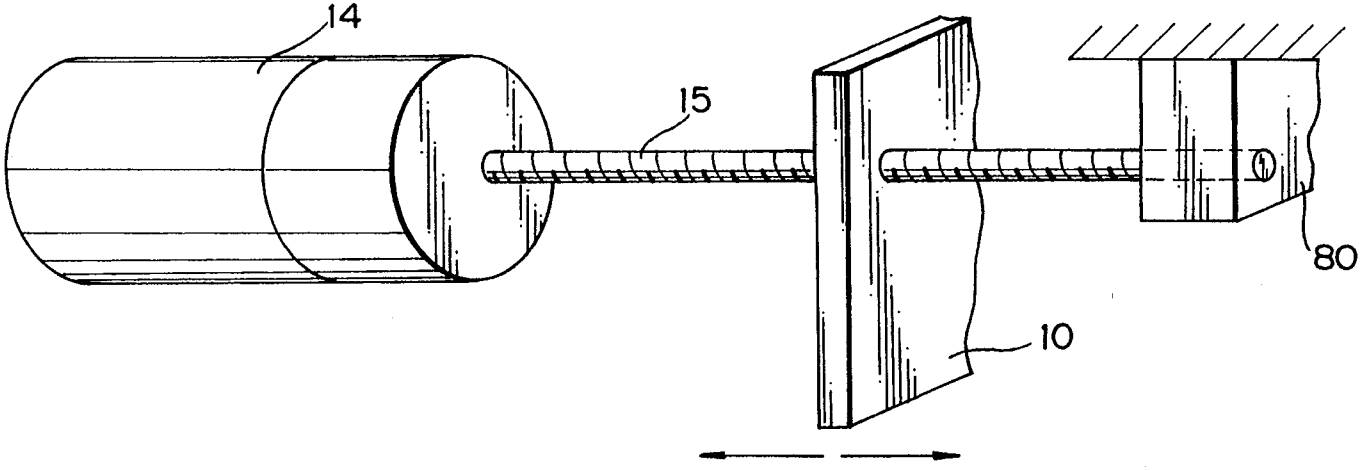
FIG. 18 is a perspective view showing a mechanism for moving a back fence.
Figure 19:
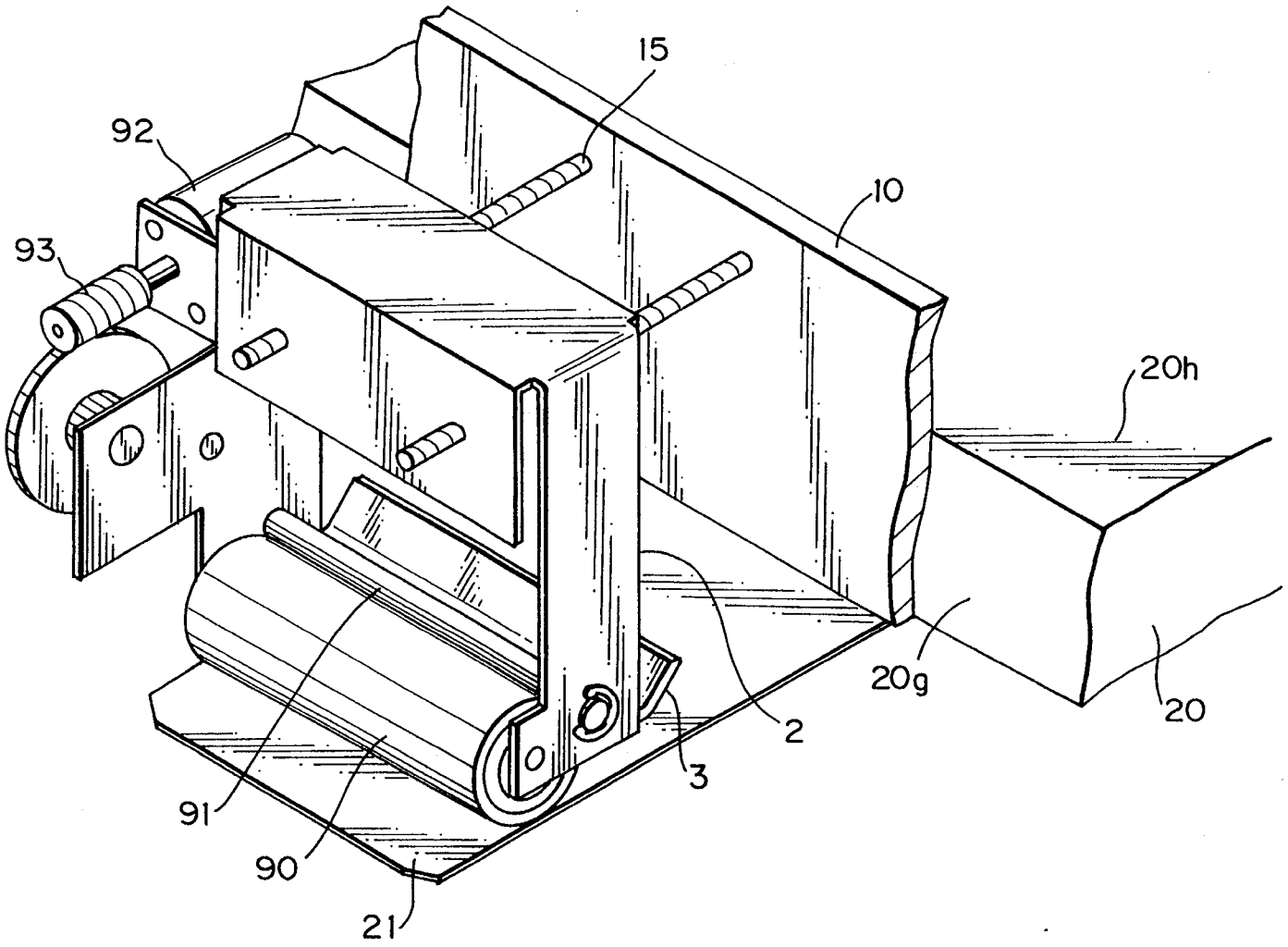
FIG. 19 is a perspective view of the back fence and an unwrapping section.

FIGS. 18 and 19 show respectively a mechanism for moving the back fence 10 and an arrangement adjoining the back fence 10 and unwrapping unit 2. The back fence 10 and unwrapping unit 2 are each formed with a female screw meshing with the screws 15. Hence, as the drive motor 14 is rotated, the back fence 10 and unwrapping unit 2 are moved. In FIG. 18, the reference numeral 80 designates a bearing.

Figure 20:
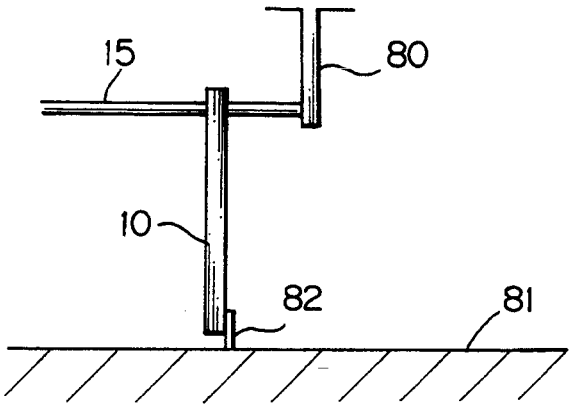
FIGS. 20 and 21 are respectively a side elevation and a front view each showing a relation between the back fence and the bottom of a sheet pack accommodating section.
Figure 21:
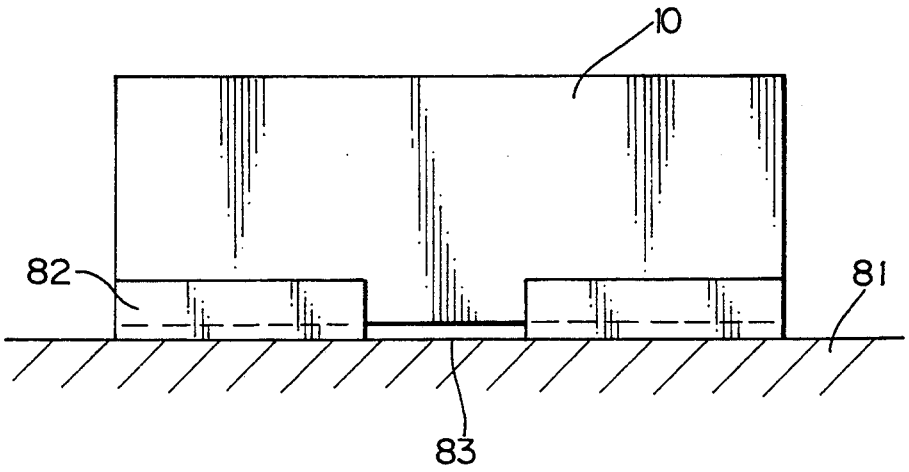

FIG. 20 shows a positional relation between the back fence 10 and the bottom of the sheet pack accommodating section. FIG. 21 is a front view associated with FIG. 20. The back fence 10 also plays the role of a member for pressing the sheet pack 20 when the pack 20 is to be unwrapped. Specifically, a clearance 83 is provided between the lower end of the back fence 10 and the bottom 81 of the sheet pack accommodating section (sheet loading surface), so that the tongue 21 of the sheet pack 20 may pass through the clearance 83. A barrier 82 is made of Mylar or similar soft material and affixed to the lower end of the back fence 10 to prevent the sheets from coming out together with the wrapping, labeled 20A and 20B, when the latter is removed from the former.

Referring again to FIG. 19, when the back fence 10 is held in a stop, the tongue 21 of the sheet pack 20 protrudes to the rear via the clearance 83 of the back fence 10. When the back fence 10 is moved, the unwrapping unit 2 is moved at the same time and then brought to a stop with a magnet roller 90 thereof resting on the tongue 21. The magnet roller 90 is covered with rubber. Also shown in FIG. 19 are a drive shaft 91 for driving the magnet roller 90, a motor 92, and a worm gear 93. Mainly made up of the magnet roller 90 and drive shaft 91, the unwrapping unit 2 is constructed such that on the increase of the required torque for unwrapping the sheet pack 20, the pressure being exerted by the magnet roller 90 on the tongue 21 and, therefore, the force tending to drive the tongue 21 also increases. The magnet roller 90 may be split into a plurality of sections, if desired. The inlet guide 3 is associated with the roller section. This, coupled with the fact that the magnet roller 90 is free to retract, causes the roller 90 to rise when the tongue 21 contacts the roller 90, facilitating the entry of the tongue 21 (see FIGS. 34A–34C).

Figure 22:
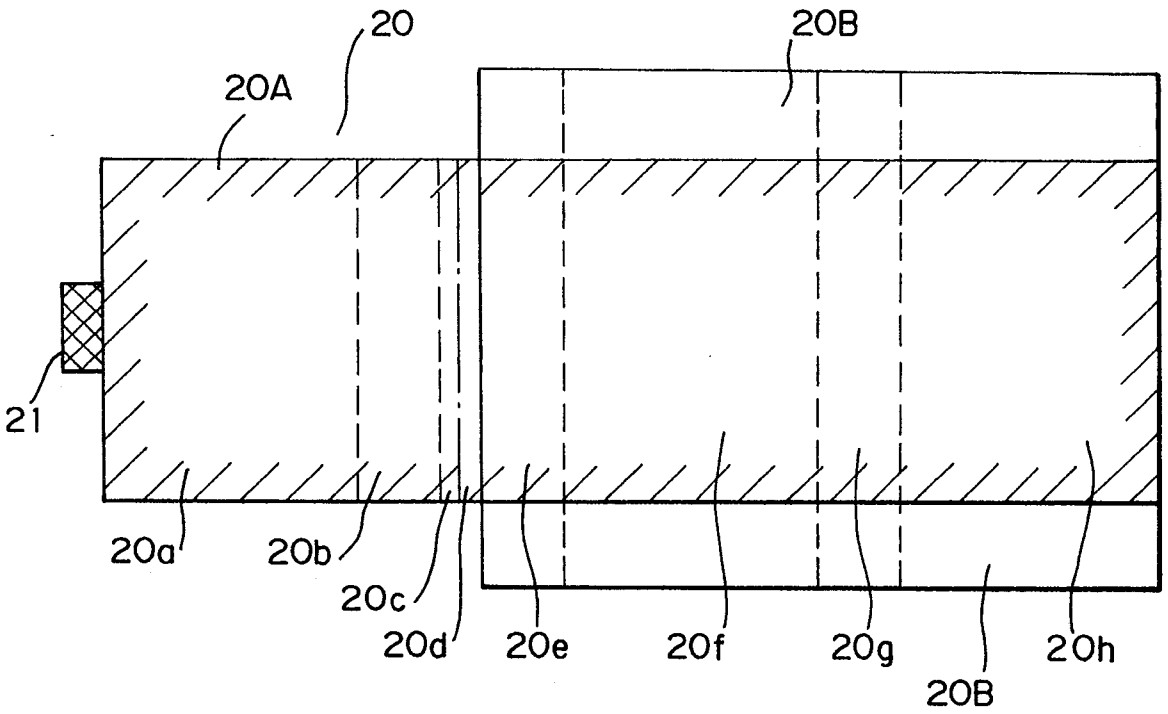
FIG. 22 is a developed view of the wrapping of a sheet pack.
Figure 23A:
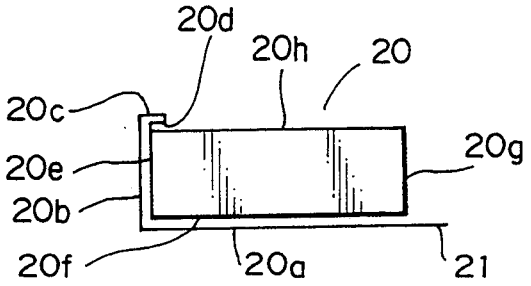
FIGS. 23A–23D demonstrate a procedure for unwrapping the sheet pack.
Figure 23B:
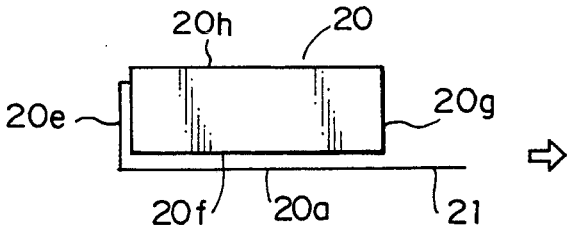
Figure 23C:
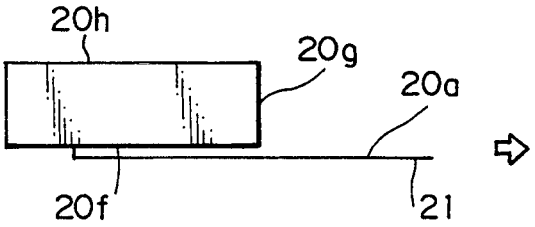
Figure 23D:
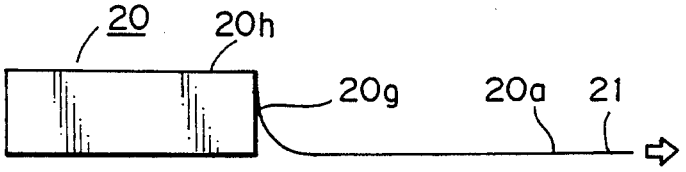
Figure 24A:
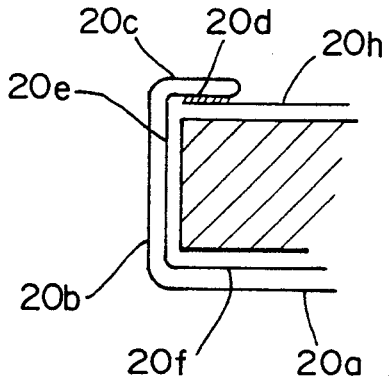
FIGS. 24A and 24B show the adhered portions of the sheet pack.
Figure 24B:
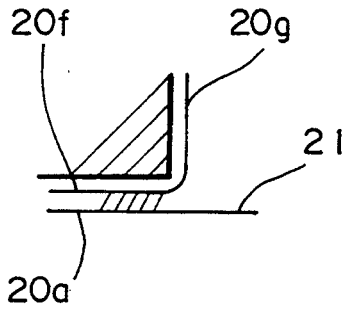

FIG. 22 is a developed view showing the wrapping 20A and 20B of the sheet pack 20. FIGS. 23A–23D demonstrate how to unwrap the sheet pack 20. FIGS. 24A and 24B show the adhered portions of the sheet pack 20. Further, FIGS. 25A–25C and 26A–26D show a procedure for wrapping the sheets. As shown, the single wrapping 20A and 20B is made up of two sheet materials each having a different strength. The wrapping portion 20A having a greater strength is constituted by consecutive sheet portions 20*a*–20*h* and the tongue 21 extending out from the sheet portion 20*a*. The tongue 21 is reinforced by Mylar or similar substance to be prevented from bending or otherwise deforming.

Figure 25A:
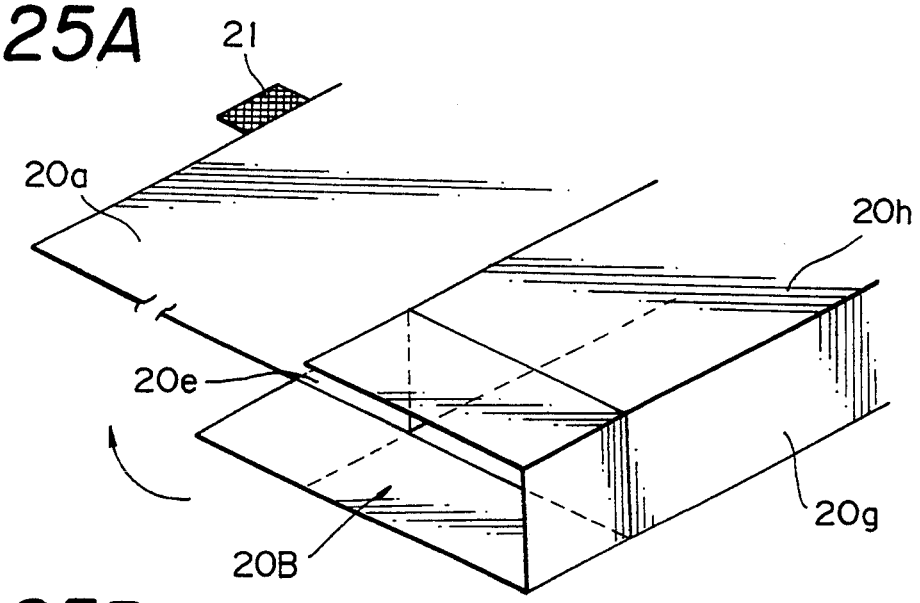
FIGS. 25A–25C and 26A–26C show how to wrap sheets for producing the sheet pack.
Figure 25B:
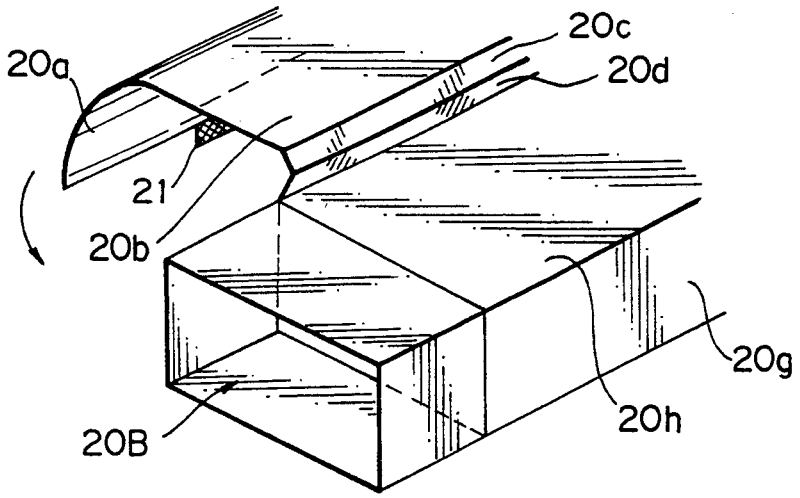
Figure 25C:
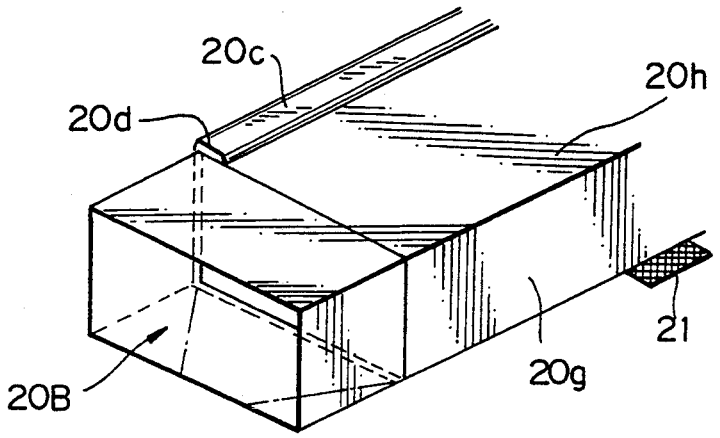
Figure 26A:
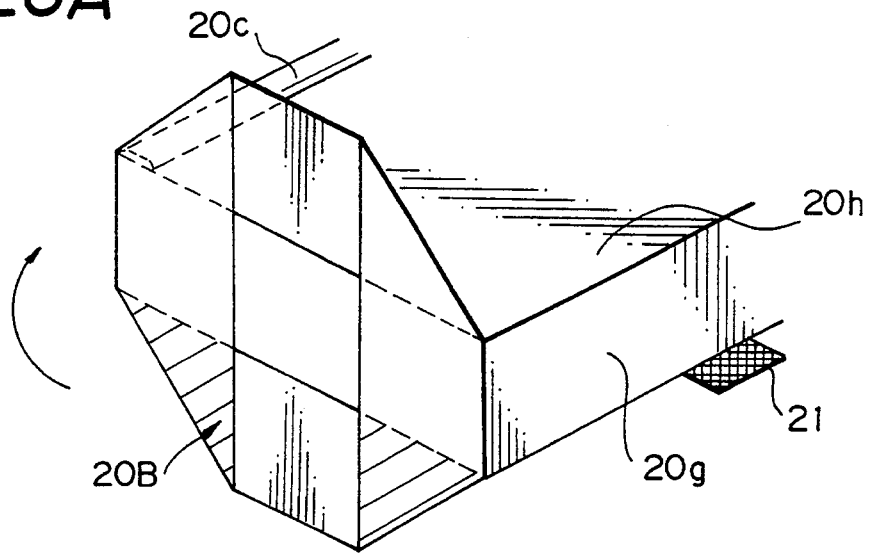
Figure 26B:
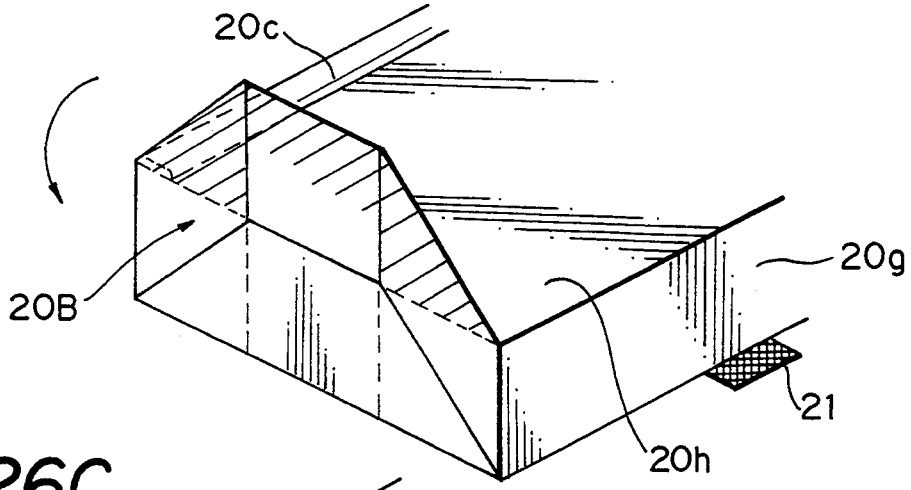
Figure 26C:
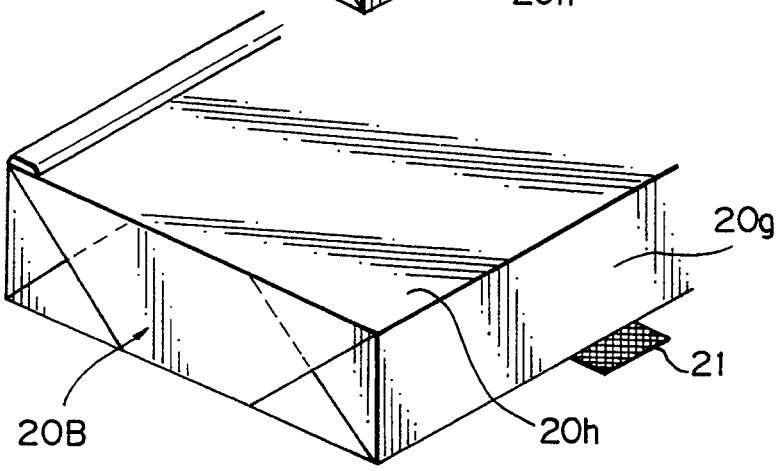

Sheets are packed by the wrapping 20A and 20B by the procedure shown in FIGS. 25A–25C, 24A and 24B. First, the wrapping 20A and 20B is wound on the sheets clockwise with the upper left portion thereof as a reference, as shown in FIG. 25A. After one round, the wrapping 20A and 20B is adhered to the reference edge thereof, as shown in FIG. 25B (see FIG. 24A). Subsequently, the wrapping 20A and 20B is turned counterclockwise until the tongue 21 reaches a position diagonal to the reference portion, as shown in FIG. 25C. Thereafter, the wrapping 20A and 20B is adhered as shown in FIG. 24B. Finally, opposite sides of the wrapping 20A and 20B are folded inward and then adhered. To unwrap the sheet pack 20, the tongue 21 of the wrapping 20A and 20B is pulled to separate the adhered portion of the packing, as shown in FIGS. 23A and 23B. Then, the tongue 21 is further pulled to cut apart the two sheet portions 20A and 20B along their boundary. FIGS. 3A–3D, like FIGS. 23A–23D, show the unwrapping procedure.

Figure 27:
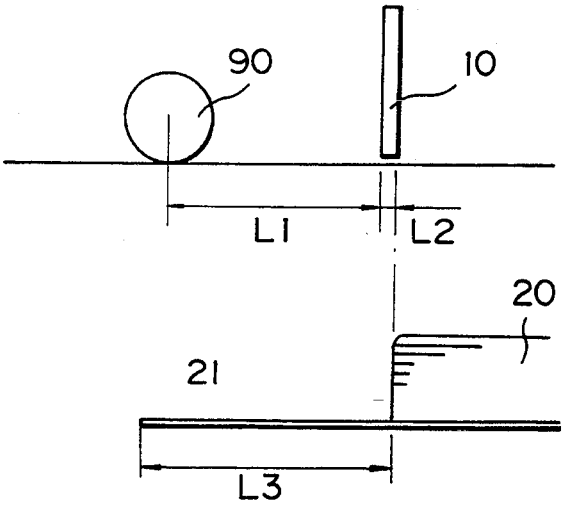
FIG. 27 is a view showing how to determine the length of a tongue.

As shown in FIG. 27, the length of the tongue 21 is dependent on the relation between the magnet roller 90 and the back fence 10. As shown, assume that the distance from the center of the magnet roller 90 to the back fence 10 is L1, the thickness of the back fence 10 is L2, and the length of the tongue 21 is L3. Then, if L3 is greater than or equal to L1+L2, the tongue 21 will be located beneath the magnet roller 90 when the back fence 10 abuts against the rear end of the sheet pack 20. Then, the magnet roller 90 can surely pull the tongue 21.

Figure 28:
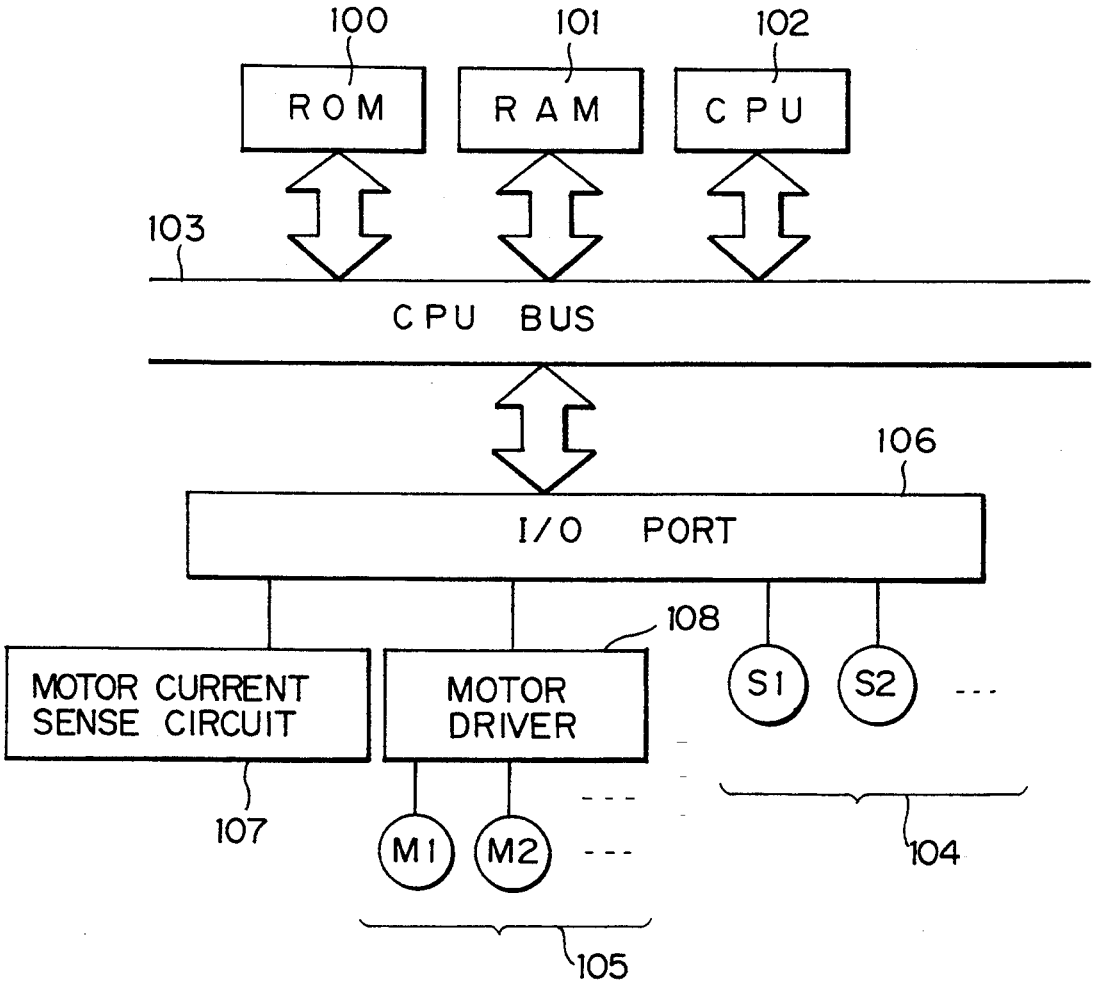
FIG. 28 is a block diagram schematically showing a control system particular to the embodiment.

FIG. 28 shows a control system particular to the illustrative embodiment. As shown, the control system includes a ROM (Read Only Memory) 100, a RAM (Random Access Memory) and a CPU (Central Processing Unit) 102 which in combination run a program for executing various kinds of control. The CPU 102 receives outputs of sensors S1, S2 and so on, collectively 104, over a bus 103 and controls motors M1, M2 and so on, collectively 105, in response to such sensor outputs. The sensors 104 include the previously mentioned sheet sensor and sheet pack sensor. The motors 105 include the sheet pack transport motor and unwrap motor. The reference numerals 106, 107 and 108 designate an I/O (Input/Output) port, a motor current detecting circuit, and a motor drive circuit, respectively.

Figure 29:
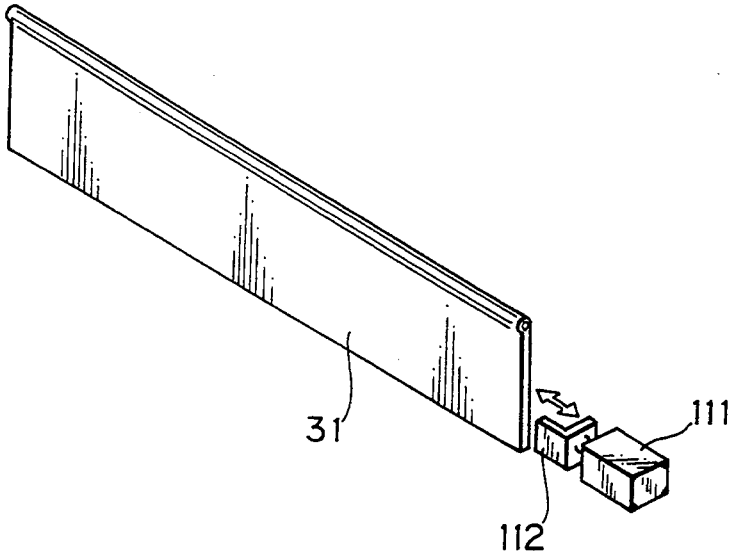
FIGS. 29–31 are views each showing a specific mechanism for locking the door.
Figure 30:
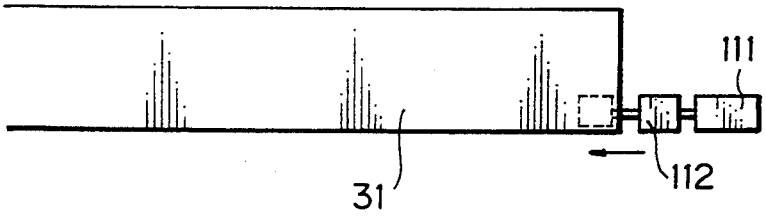
Figure 31:
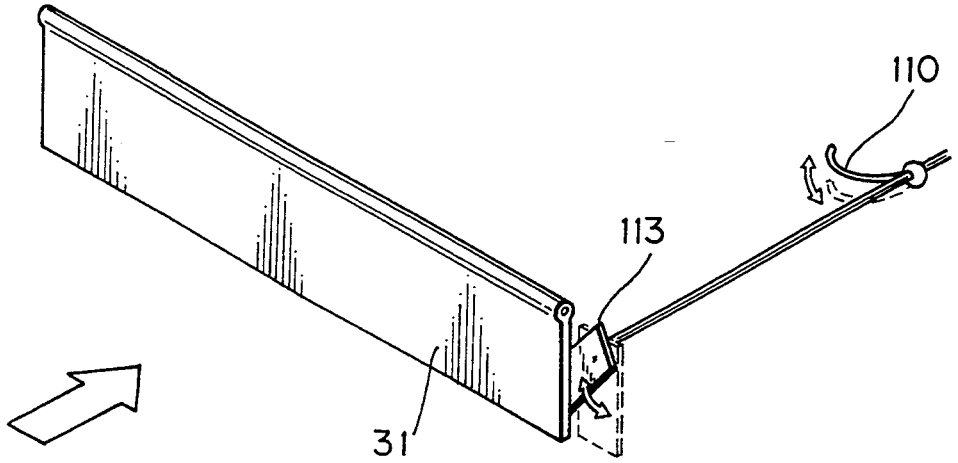
Figure 32:
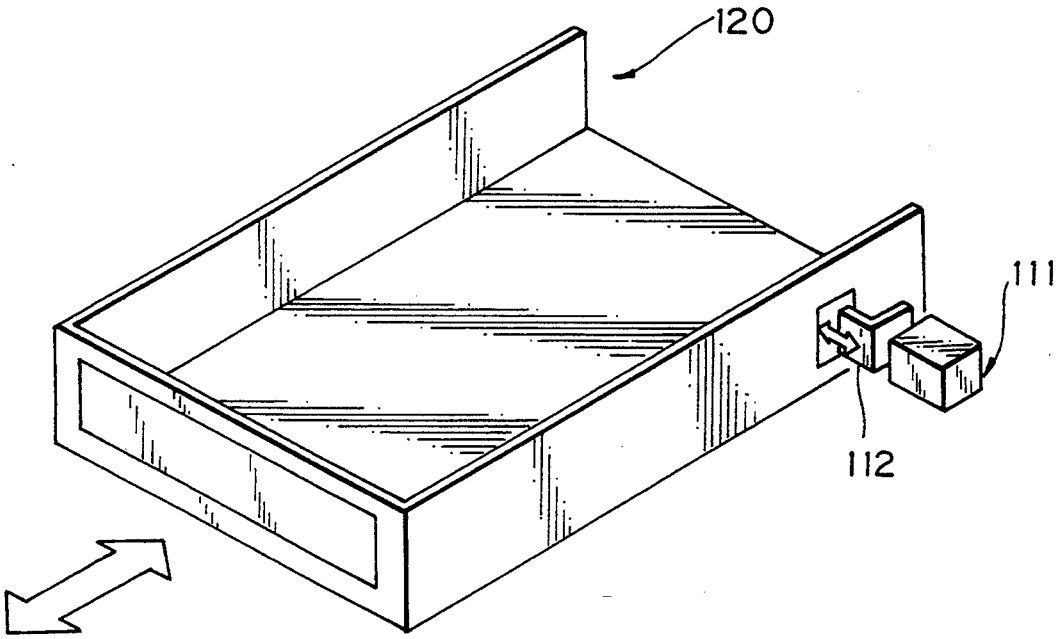
FIG. 32 is a perspective view showing a mechanism for locking a cassette.

FIGS. 29 and 30 show a specific arrangement for locking and unlocking the door (represented by the door 31). FIG. 31 shows another specific arrangement for locking and unlocking the door. In FIGS. 29 and 30, only when a paper end feeler 110, FIG. 31, is lowered to indicate a paper end condition, a solenoid 111 is turned on to retract a locking member 112. Then, the door 31 is freely openable. Likewise, in FIG. 31, a door lock feeler 113 is selectively opened or closed. This kind of arrangement may also be applied to a sheet cassette, if desired. Specifically, as shown in FIG. 32, the locking member 112 affixed to the end of the solenoid 111 is movable into and out of a sheet cassette 120 via one side wall of the cassette 120, allowing the cassette 120 to be removed only when it has run out of sheets.

Figure 33:
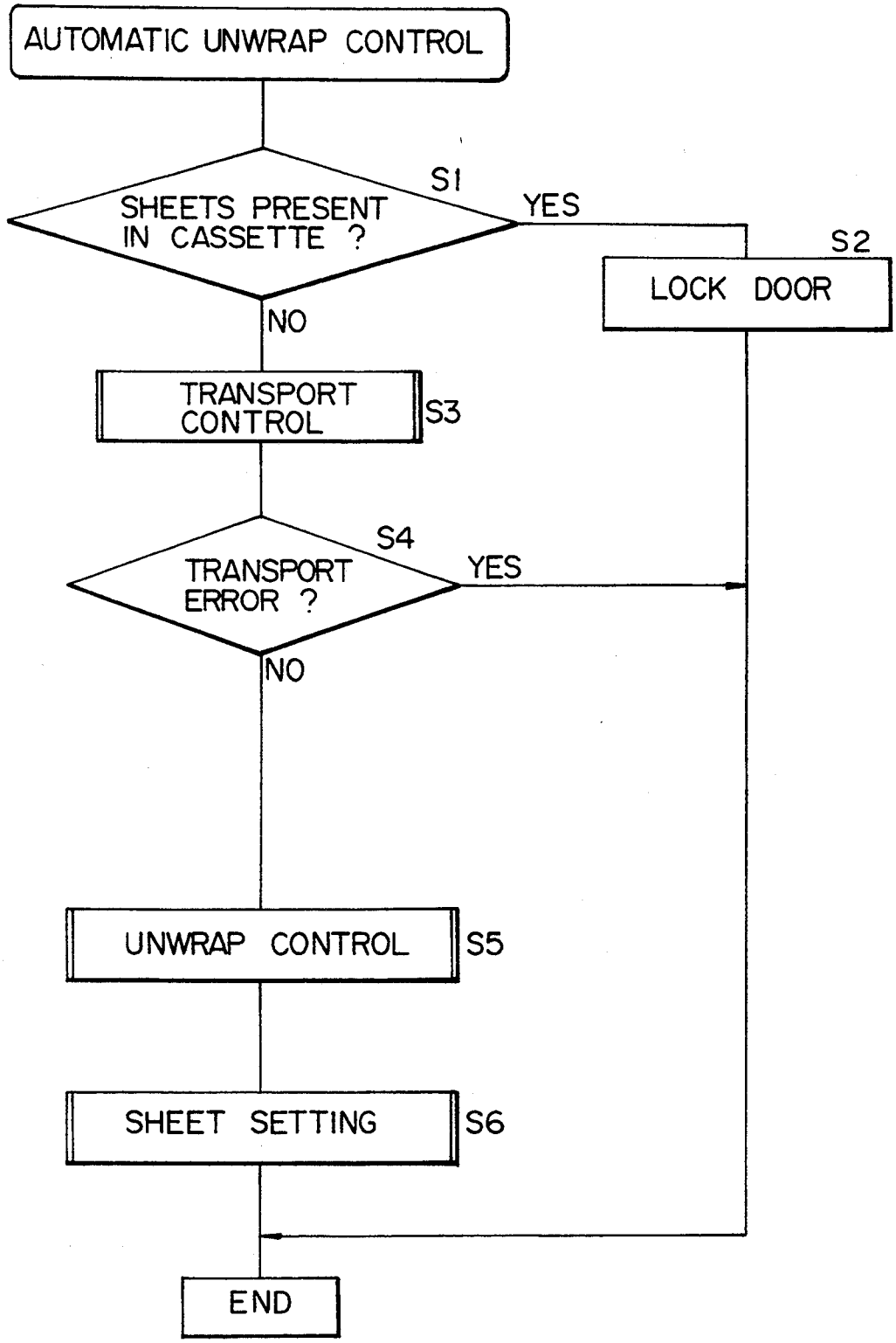
FIG. 33 is a flowchart demonstrating a main routine.

Referring to FIG. 33, a main control routine (automatic unwrap control) to be executed by the CPU 102, FIG. 28, is demonstrated. As shown, the CPU 102 determines whether or not sheets are present in the cassette 120 (step S1). If the answer of the step S1 is positive, the CPU 102 locks associated one of the doors 31–33 (S2) to prevent a sheet pack 20 from being inserted into the cassette 120 or, if it is inserted, does not execute transport control. When the cassette 120 has run out of sheets, the CPU 102 retracts the back fence 10 and side fences 7 while lowering a bottom plate 6. At this instant, the CPU 102 maintains the door in the locked position for intercepting the sheet pack 20. It is to be noted that the back fence 10 is retracted to a position outside of the portion where the cassette 120 (or the tray 6) is to be pulled out while the side fences 7 are each retracted to a position outside of the maximum sheet size. Subsequently, the CPU 102 unlocks the door, transports the inserted sheet pack 20 to the tray 6 or the cassette 120, and then executes a transport control subroutine (S3) for determining the sheet size. If a transport error is not found (NO, S4), the CPU 102 executes unwrap control subroutine (S5) and then a sheet set subroutine (S6).

Figure 34A:
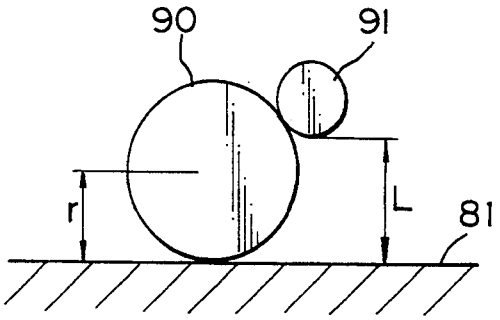
FIGS. 34A–34C are views indicative of a relation between a magnet roller and a drive shaft included in an unwrapping unit.
Figure 34B:
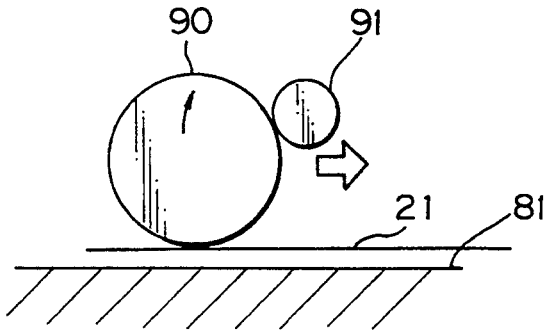
Figure 34C:
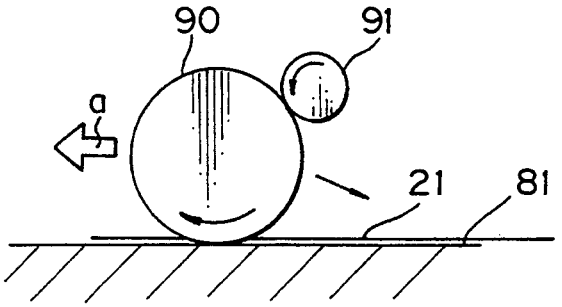

How to unwrap the sheet pack 20 is as follows. FIGS. 34A–34C are indicative of a positional relation between the magnet roller 90 and the drive shaft 91 shown in FIG. 19. As shown in FIG. 34A, the drive shaft 91 is located upstream of the magnet roller 90. The distance L between the bottom of the pack accommodating section (sheet loading surface) 81 and the lower end of the drive shaft 91 is smaller than the diameter $2r$ of the magnet roller 90, but the former is greater than the radius r of the latter (i.e. $r \leqq L < 2r$). As shown in FIG. 34B, when the tongue 21 is brought to beneath the magnet roller 90, the roller 90 pulls the tongue 21 without being rotated. At this instant, the back fence 10 is held in the position where it has set the sheet pack 20. Hence, the back fence 10 stops the sheets when the magnet roller 90 is rotated to pull the pack in a direction $\alpha$, as shown in FIG. 34C. As a result, the magnet roller 90 unwraps the sheet pack 20 by pulling the wrapping (see FIGS. 3A–3D). The unwrapping unit 2 is moved to the dust bin 1 while sequentially removing the wrapping of the sheet pack 20. The sheet loading surface 81 facing the magnet roller 90 is implemented by a Teflon sheet or similar low friction material.

Figure 35:
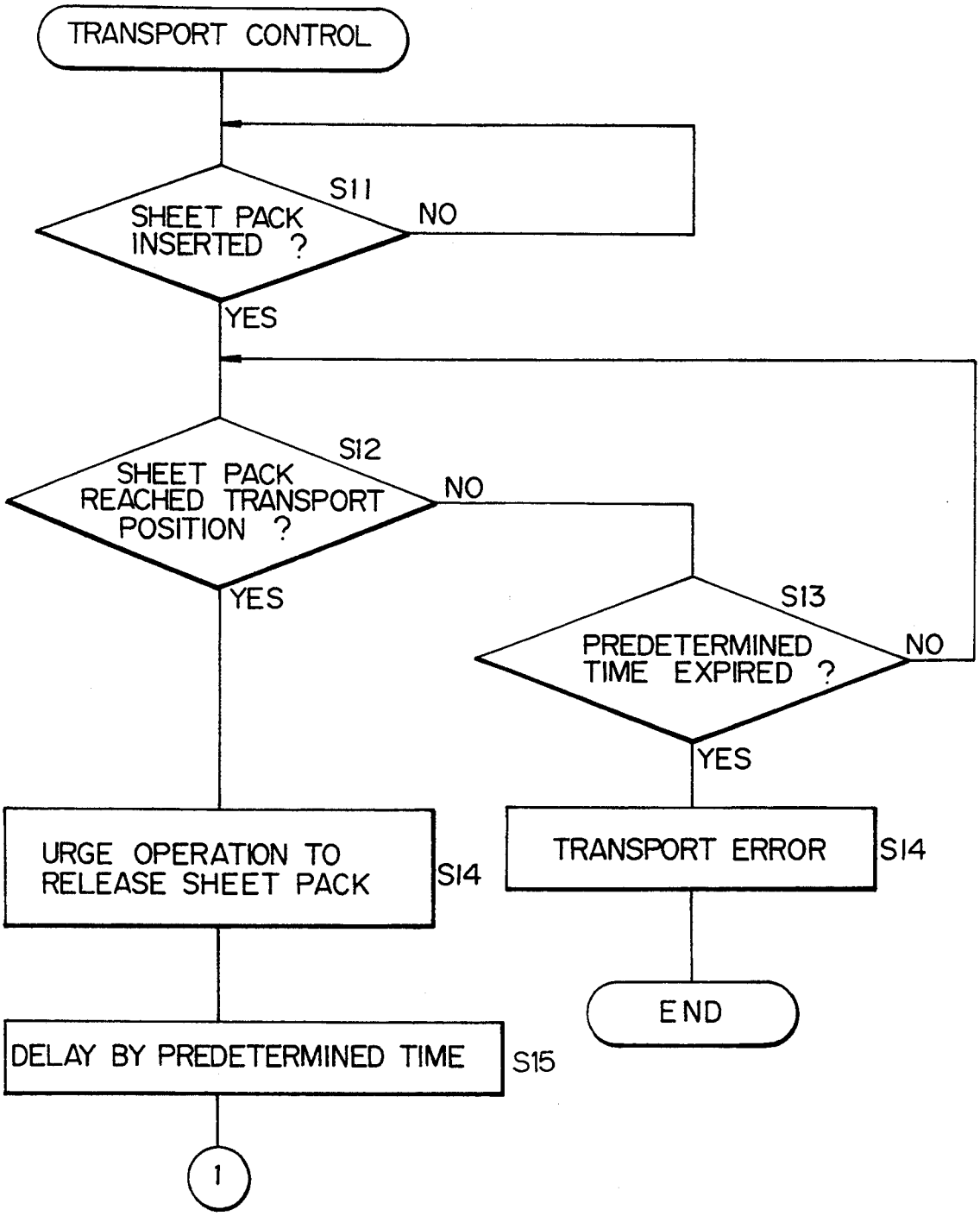
FIGS. 35–37 are flowcharts representative of a transport control subroutine, a transport control subroutine, and an unwrap subroutine, respectively.
Figure 36:
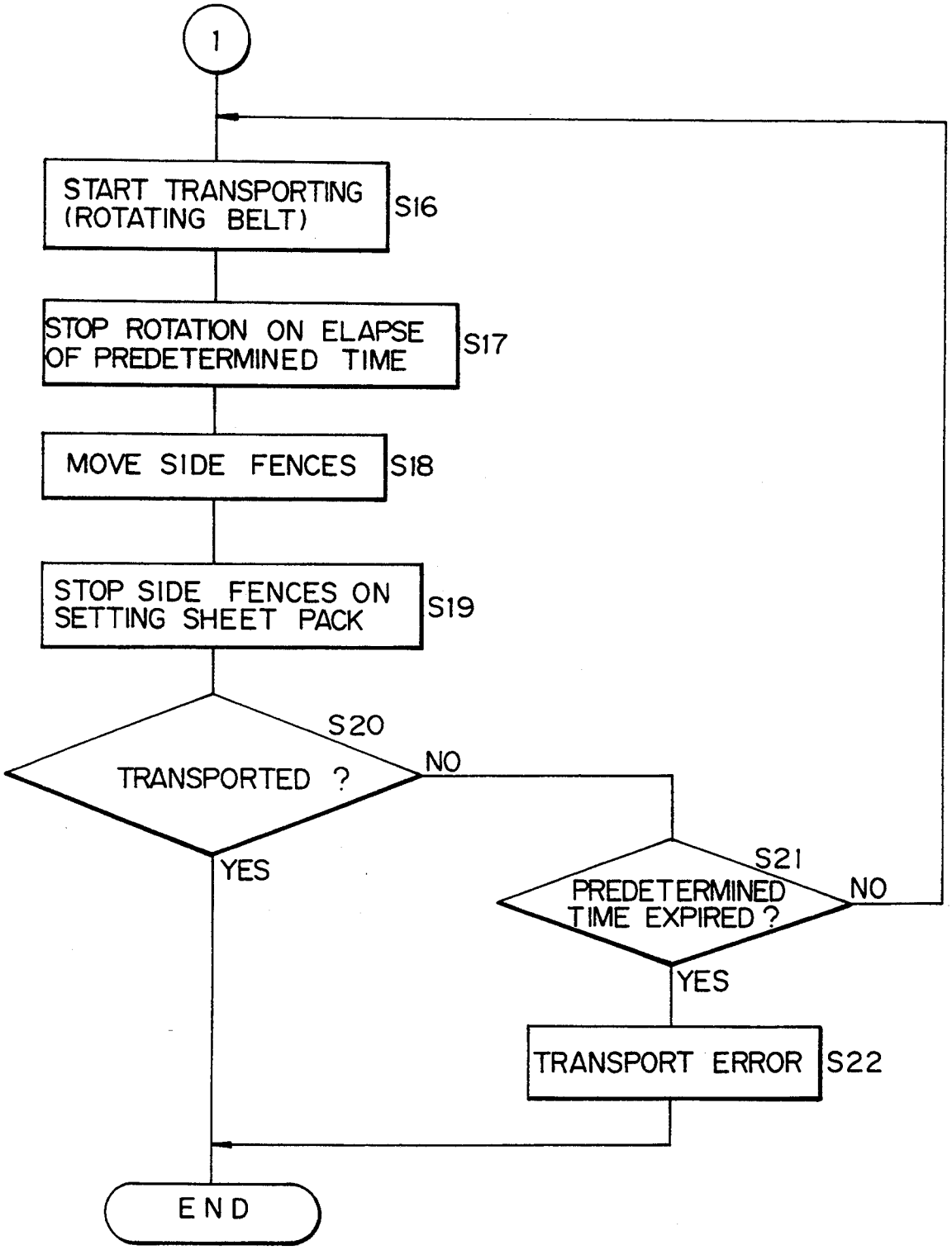

The pack transport control subroutine will be described with reference to FIGS. 35 and 36. First, when the sheet pack 20 is inserted (YES, S11), the CPU 102 determines whether or not the pack 20 has reached a reference transport start position (S12). Specifically, regarding the reference transport start position, the transport roller 8 should start transporting the sheet pack 20 after the operator has inserted more than one half of the pack 20 into the mechanism, so that the pack 20 may be prevented from falling due to gravity. However, this is not a prerequisite if some measure against the fall of the sheet pack 20 is taken (e.g. pressing means). The insertion of the sheet pack 20 is sensed by, for example, the reflection type sensor 40, FIG. 10, located in the vicinity of the sheet inlet. The sensor 40 may sense a mark provided on the sheet pack 20. This mark may also serve as a size sensing mark which will be described. The position of the mark for determining a transport start position is such that the sheet pack 20 reaches the transport roller 8 and can be surely transported by the roller 8. When the mark is positioned at a predetermined distance from the trailing end of the sheet pack 20 in the direction of insertion with no regard to the sheet size, the transport of the pack 20 will begin when the pack 20 is inserted to a predetermined position with no regard to the size thereof. This is successful in freeing the operator from erroneous operations.

The CPU 102 counts the insertion time (S13). If the insertion of the sheet pack 20 is incomplete, i.e., when a transport error occurs (S14), the CPU 102 urges the operator to remove the sheet pack 20 and then insert it again. For this purpose, the CPU 102 may count the time needed for the sheet pack 20 to be inserted as far as the mark thereof or the time during which associated one of the doors 31–33 is left open. Assume that the mark on the sheet pack 20 is not detected or that the mark is different from a predetermined one. Then, the CPU 102 determines that the sheet pack 20 is not expected one or that the orientation of the pack 20 is not correct and again urges the operator to set it again without starting on the transport.

As the sheet pack 20 reaches the position where it can be transported, the CPU 102 urges the operator to release the pack 20 by, for example, displaying a message or energizing a buzzer (S14). Thereafter, the CPU 102 causes the transport roller 8 to rotate to thereby start transporting the sheet pack 20 (S16). At this instant, the start of transport is delayed by a period of time sufficient for the operator to release the sheet pack 20 (S15), thereby eliminating erroneous operations. At the same time, the CPU 102 determines the size of the sheet pack 20 by, for example, the sensor 40 responsive to the bar code 41, FIG. 10, or similar mark or by counting the time necessary for the leading end of the pack 20 to move away from the sensor 40. Further, such an implementation may be combined with the previously stated size (width) sensing associated with the door (31–33). So long as the size of the sheet pack 20 is the same as the size of sheets having been used, the CPU 102 continues the control; if otherwise, the CPU 102 interrupts the transport and alerts the operator to such a condition. Then, the operator will reverse the transport roller to discharge the sheet pack 20 by operating, for example, a predetermined switch.

As soon as the sheet pack 20 moves away from the front side fence 7*a*, the side fence 7*a* is automatically returned to the upright position. As a sensor, not shown, senses the rise of the side fence 7*a*, the CPU 102 stops driving the transport roller 8 (S17). If the side fence 7*a* does not rise in a predetermined period of time as determined by the sensor, the CPU 102 stops driving the transport roller 8 and displays a transport error, determining that an error has occurred in the transport of the sheet pack 20. Subsequently, the front and rear side fences 7*a* and 7*b* are moved toward each other to position the sheet pack 20 at the center (S18). At this instant, the side fences 7*a* and 7*b* are each brought to a stop at a position matching the sheet size sensed beforehand (S19). If the sheet size is not known beforehand, the movement of the side fences 7*a* and 7*b* is stopped on detecting a motor current which will be described or, alternatively, by detecting the contact of the sheet pack 20 with a sensor provided on the side fence 7*b*. If desired, a plurality of sensors may be provided on the side fence 7*b* in an array extending in the sheet feed direction so as to correct the skew of the sheet pack 20. Thereafter, the CPU 102 determines whether or not the sheet pack 20 has been fully transported (S20). If the answer of the step S20 is negative, the CPU 102 displays a transport error (S22) on the elapse of a predetermined period of time (S21).

Figure 37:
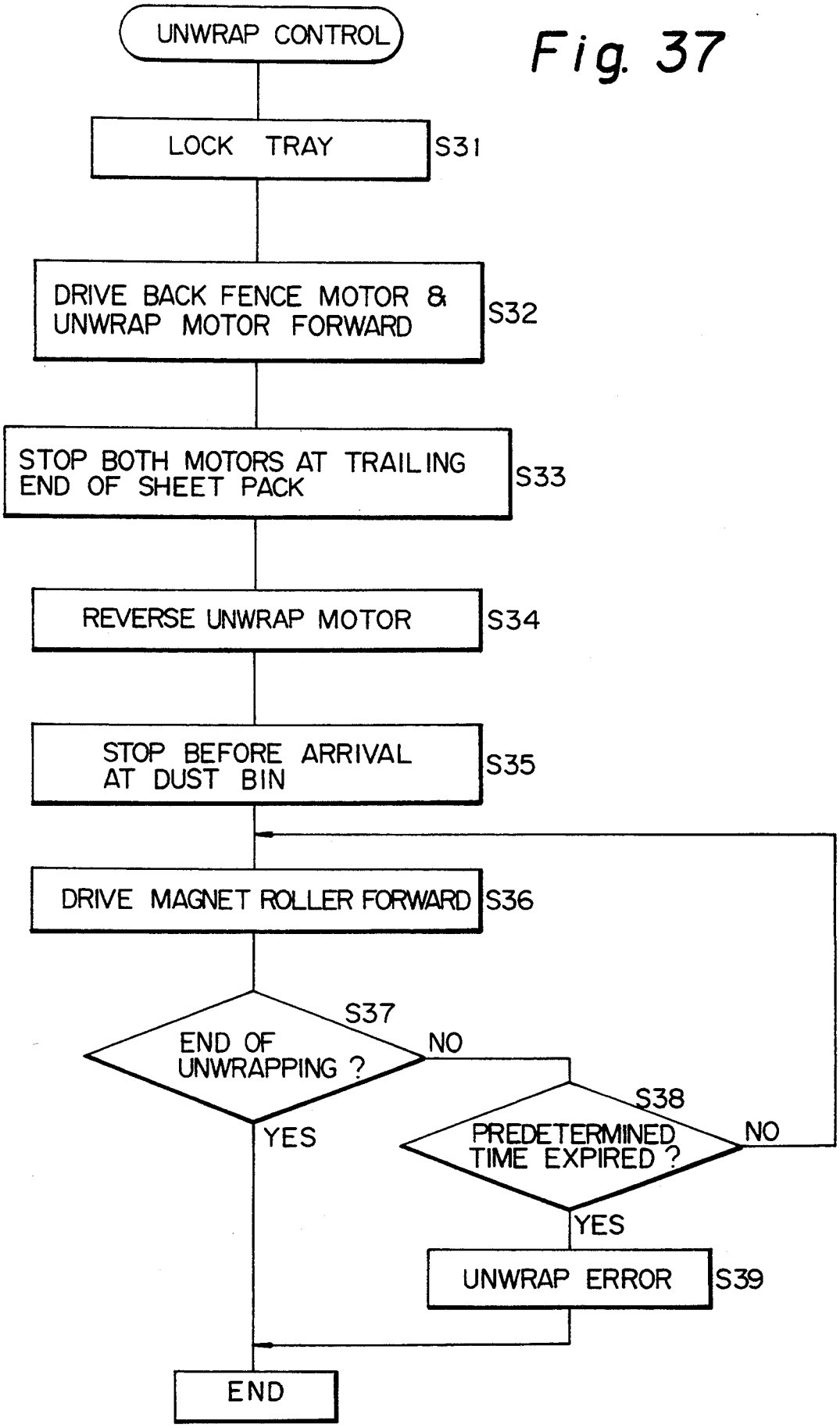

FIG. 37 shows the unwrap control subroutine specifically. The subroutine begins with a step S31 for locking the tray 6 (or the cassette 120). This is to prevent the sheet pack 20 from being pulled out while the unwrapping procedure is under way. For locking the tray 6 (or the cassette 120), use may be made of the solenoid 111 shown in FIG. 29. In FIG. 29, to unlock the cassette 120, the solenoid 111 is turned on to retract the locking member 112 to thereby release the cassette 120; to lock cassette 120, the solenoid 111 is turned off to cause the locking member 112 to protrude toward it. Subsequently, the CPU 102 rotates the back fence motor 14*b* and unwrap motor 14*a* in the forward direction (S32) to move the back fence 10 and unwrapping unit 2 toward the sheet pack 20. Then, the CPU 102 stops them at a position matching the sheet size (S33). At this instant, the unwrapping unit 2 has gripped the tongue 21 of the sheet pack 20.

In the above condition, the CPU 102 reverses only the unwrap motor 14*a* (S34) with the result that the unwrapping unit 2 moves rearward while gripping the tongue 21. The CPU 102 deenergizes the unwrap motor 14*a* before the unwrapping unit 2 reaches the dust bin 1 (S35). Subsequently, the CPU 102 starts rotating the magnet roller 90 (S36) to unwrap the sheet pack 20. If the tongue 21 is absent due to the fact that the sheet pack 20 is not exclusive one or the pack 20 is misoriented or if the unwrapping unit 2 has failed to grip the tongue 21, the CPU 102 detects it also. In such a condition, the motor current of the unwrap motor 14*a* increases due to the friction between the magnet roller 90 and the sheet loading surface 81. Hence, it is possible to detect an error by detecting the motor current. In this case, the CPU 102 again presses the unwrapping unit 2 against the sheet pack 20 to repeat the unpacking operation. If the error is not removed even after the unwrapping operation has been repeated a plurality of times, the CPU 102 stops it and displays an error (S39, i.e., NO, S37 and YES, S38).

As the sheet pack 20 is fully unwrapped (YES, S37), the CPU 102 stops rotating the magnet roller 90 while maintaining the unwrapping unit 2 at the receded position. The end of the unwrapping operation may be detected by detecting the motor current which drives the magnet roller 90. Specifically, the torque rotating the magnet roller 90 is low during the transport of the unwrapped sheet pack 20, but it sharply increases when the pack 20 is fully unwrapped due to friction between the magnet roller 90 and the sheet loading surface 81. Hence, it is possible to detect the full unwrapping of the sheet pack 20 on the basis of a difference between the motor currents.

When the inlet sensor 40 is not used to sense the sheet size, the side fences 7 or the back fence 10 may be used. When the side fences 7, for example, are moved until they abut against the sheet pack 20, they cannot be moved any further with the result that the current of the side fence drive motor 70 increases. Therefore, it is possible to detect the sheet size by counting the interval between the start of movement of the side fences 7 and the increase in the current of the motor 70.

Further, to detect the end of the sheet pack 20, a sensor may be provided on the rear side fence 7*b*. The displacement of the side fences 7 may be determined in terms of the period of time as stated above or in terms of the output pulses of an encoder mounted on the side fence drive motor 70. This is also true with the back fence 10. Again, if the size of the sheet pack 20 is the same as that of the sheets having been used, the CPU 102 continues the control. However, if the former is different from the latter, the CPU 102 alerts the operator to the difference so as to allow the operator to select either the execution of the operation or the resetting of the sheet pack 20. This prevents the sheet pack 20 from being unwrapped by accident.

During the unwrapping operation described above, a message, e.g., "UNWRAPPING" is displayed to allow the operator to see the current state. Also, the end of such an operation is indicated by a message, e.g., "UNWRAPPED" or by a buzzer. Even during the unwrapping operation, the operator can select the cassette 120, enter a desired number of copies, set desired modes including a sorter mode, etc. The copier, therefore, automatically starts on a copying operation as soon as the sheet pack 20 has been unwrapped.

To supplement unwrapped sheets while sheets are still left on the tray 6 (or the cassette 120), the operator may press a particular switch. Then, the bottom plate is lowered, and the back fence 10 is moved rearward. Before the back fence 10 fully recedes to the rearward position, the cassette 120, for example, is locked in position. On the arrival of the back fence 10 at the rearward position, the cassette 120 is unlocked. After the tray 6 (or the cassette 120) has been pulled out and loaded with supplementary sheets, it is set again. Then, the cassette 120, for example, is locked in position while the back fence 10 is moved forward until it abuts against the sheets. Thereafter, the bottom plate is raised to prepare for the feed of the sheets.

In summary, it will be seen that the present invention provides a sheet feed device having sheet pack transporting means for automatically setting a sheet pack inserted by an operator at a feed position defined in the device body, and unwrapping means for automatically removing a wrapping from the pack. The device, therefore, makes the sheet supplementing operation extremely simple.

The device of the invention unwraps the sheet pack while maintaining the pack at the sheet feed position and does not move unwrapped sheets. This prevents the neat stack of sheets from being disturbed in the event of and after unwrapping.

The unwrapping means is implemented as pulling means which grips a tongue extending out from the wrapping and pulls it away from the sheet pack to thereby remove the wrapping. Therefore, the unwrapping means is extremely simple in construction.

The device automatically sets the sheet pack inserted by an operator at the feed position defined in the device body and then automatically removes the wrapping, as stated above. In addition, a door openably closing a sheet inlet whose one side is used as a reference is divided in matching relation to the sizes of sheet packs. This allows sheet packs of various sizes to be easily inserted to a predetermined position and, therefore, facilitates the supplement of sheets to a significant degree.

The size of a sheet pack to be inserted is determined on the basis of the open/close states of the doors each being associated with a particular sheet inlet. Hence, not only a sheet pack size can be sensed at the time when a sheet pack is inserted, but also a mechanism for sensing the sheet pack size is simplified.

The device automatically sets the sheet pack inserted by an operator at the feed position defined in the device body and then automatically removes the wrapping. In addition, pack insertion positions each matching a particular sheet pack size are indicated at the sheet inlets. This is also successful in allowing sheet packs of various sizes to be easily inserted to a predetermined position and, therefore, in facilitating the supplement of sheets to a significant degree.

The device automatically sets the sheet pack inserted by an operator at the feed position defined in the device body and then automatically removes the wrapping. In addition, a guide member is provided on the front of each door. The guide member is slidable to a position matching any particular sheet pack size and collapses rearward on the insertion of a sheet pack. This is also successful in allowing sheet packs of various sizes to be easily inserted to a predetermined position and, therefore, in facilitating the supplement of sheets to a significant degree.

As the operator inserts a sheet pack into an accommodating section, the device automatically transports it to feeding means and then removes the wrapping of the sheet pack. This frees the operator from troublesome action in the event of supplementing sheets. Furthermore, the device does not feed sheets while it unwraps a sheet pack. This clearly shows the operator why sheets cannot be fed despite that they are present, facilitating the manipulation of the device.

Various modifications will become possible for those skilled in the art after receiving the teachings of the present disclosure without departing from the scope thereof.

What is claimed is:

1. A sheet feed device capable of automatically removing a wrapping from a sheet pack inserted into an image forming apparatus, said device comprising:
- a device body defining an enclosure having at least first and second side walls;
- an inlet formed through one of said first and second side walls of said device body for allowing the sheet pack to be inserted;
- transporting means for transporting the sheet pack inserted through said inlet to a predetermined position defined in said device body, said predetermined position defining an individual sheet feed position; and
- unwrapping means for removing the wrapping from the sheet pack located at said predetermined position, said unwrapping means removing the wrapping of the sheet pack located at said sheet feed position, wherein said unwrapping means solely comprises pulling means for pressing against a tongue of the wrapping extending out from one end of the sheet pack and then pulling said tongue away from said sheet pack while pressing against said tongue to thereby remove said wrapping.

2. A device as claimed in claim 1, further comprising a back fence for pressing against a side of said sheet pack where the tongue is positioned while said tongue is being pulled by said pulling means.

3. A sheet feed device capable of automatically removing a wrapping from a sheet pack inserted into an image forming apparatus, said device comprising:
- a device body defining an enclosure having at least first and second side walls;
- an inlet formed through one of said first and second side walls of said device body for allowing the sheet pack to be inserted, said wrapping comprising a tongue which extends from one end of said sheet pack;
- transporting means for transporting the sheet pack inserted through said inlet to a predetermined position defined in said device body, said predetermined position defining an individual sheet feed position; and
- unwrapping means for removing the wrapping from the sheet pack located at said predetermined position, said unwrapping means solely comprising pressing means for pressing against said tongue and pulling said tongue away from said sheet pack to remove said wrapping;
- said transporting means comprising a first rotatable member disposed above a transport surface along which the sheet pack is transported.

4. A device as claimed in claim 3, further comprising an second rotatable member being adapted to contact said sheet pack, said second rotatable member being drivingly connected to said first rotatable member.

5. A device as claimed in claim 3, wherein said transport surface is formed by a low friction member.

6. A sheet feed device capable of automatically removing a wrapping from a sheet pack inserted into an image forming apparatus, said device comprising:
- a device body defining an enclosure having at least first and second side walls;
- an inlet formed through one of said first and second side walls of said device body for allowing the sheet pack to be inserted, said wrapping comprising a tongue which extends from one end of said sheet pack;
- transporting means for transporting the sheet pack inserted through said inlet to a predetermined position defined in said device body, said predetermined position defining an individual sheet feed position; and
- unwrapping means for removing the wrapping from the sheet pack located at said predetermined position, said unwrapping means solely comprising pressing means for pressing against said tongue and pulling said tongue to remove said wrapping;
- said transporting means being movable between a transport position for transporting the sheet pack in contact with said sheet pack and a retracted position where said transporting means does not contact said sheet pack, said transporting means being held in said retracted position while sheets are fed.

7. A sheet feed device capable of automatically removing a wrapping from a sheet pack inserted into an image forming apparatus, said device comprising:
- a device body defining an enclosure with at least first and second side walls;
- an inlet formed through one of said first and second side walls of said device body for allowing the sheet pack to be inserted;

a sheet loading surface where the sheet pack inserted via said inlet is to be located;

transporting means for transporting the sheet pack inserted through said inlet and located at said loading surface to a predetermined position defined in said device body; and unwrapping means for removing the wrapping from the sheet pack located at said predetermined position, said unwrapping means solely comprising pressing means for pressing against a tongue portion of said wrapping which extends from said sheet pack and pulling said tongue portion to remove the wrapping from the sheet pack;

said transporting means comprising:

a first rotatable body disposed above the sheet pack when said sheet pack is inserted;

a second rotatable body supported by a support member in such a manner as to move in a planetary motion around said first rotatable body and to contact, when located at a predetermined position on the periphery of said first rotatable member, an upper surface of the sheet pack;

transmitting means for transmitting a rotation of said first rotatable member to said second rotatable member;

false loading means for exerting a load on said second rotatable member;

reversing means for causing said first rotatable member to rotate in a direction opposite to a direction in which the sheet pack is transported; and drive control means for driving said reversing means after the sheet pack has been transported to said predetermined position.

* * * * *